US012507728B1

(12) United States Patent
Belziti

(10) Patent No.: US 12,507,728 B1
(45) Date of Patent: Dec. 30, 2025

(54) MODULAR SMOKING PIPE

(71) Applicant: Richard R. Belziti, Howard Beach, NY (US)

(72) Inventor: Richard R. Belziti, Howard Beach, NY (US)

( * ) Notice: Subject to any disclaimer, the term of this patent is extended or adjusted under 35 U.S.C. 154(b) by 522 days.

(21) Appl. No.: 17/747,067

(22) Filed: May 18, 2022

Related U.S. Application Data

(60) Provisional application No. 63/190,179, filed on May 18, 2021.

(51) Int. Cl.
*A24F 1/28* (2006.01)
*A24F 5/00* (2006.01)
*A24F 7/02* (2006.01)

(52) U.S. Cl.
CPC ..... *A24F 1/28* (2013.01); *A24F 5/00* (2013.01); *A24F 7/02* (2013.01)

(58) Field of Classification Search
CPC ..... A24F 1/00; A24F 3/00
USPC ..... 131/187
See application file for complete search history.

(56) References Cited

U.S. PATENT DOCUMENTS 4,193,411 A * 3/1980 Faris ..... A24F 1/00 131/330
5,353,814 A * 10/1994 Martin ..... A24F 13/00 131/215.2
5,472,001 A * 12/1995 Nicholson ..... A24F 13/14 131/234
2019/0307165 A1* 10/2019 Carney ..... A24F 13/06

FOREIGN PATENT DOCUMENTS

CN 112369699 A * 2/2021 ..... A24D 1/20
DE 102006048125 B4 * 5/2010 ..... A24F 5/00
WO WO-2014195687 A1 * 12/2014 ..... A24F 15/12

OTHER PUBLICATIONS

Machine translation of DE 102006048125 B4 (Year: 2024).*
Machine translation of CN 112369699 A (Year: 2025).*

* cited by examiner

*Primary Examiner* — Michael H. Wilson
*Assistant Examiner* — Tobey C Le
(74) *Attorney, Agent, or Firm* — Collard & Roe, P.C.

(57) ABSTRACT

There is a modular smoking pipe comprising a body section, at least one mouthpiece, at least one input coupled to said body section, at least one fan, at least one opening coupled to the body section; and at least one bowl for receiving smoking material. The bowl is coupled to the body section and the fan is coupled to the input. The opening is configured to receive a flame, wherein the fan is configured to push air through said at least one opening to drive a flame into said bowl to ignite the smoking material and to drive smoke through the body to the mouthpiece.

19 Claims, 38 Drawing Sheets

FIG. 32A
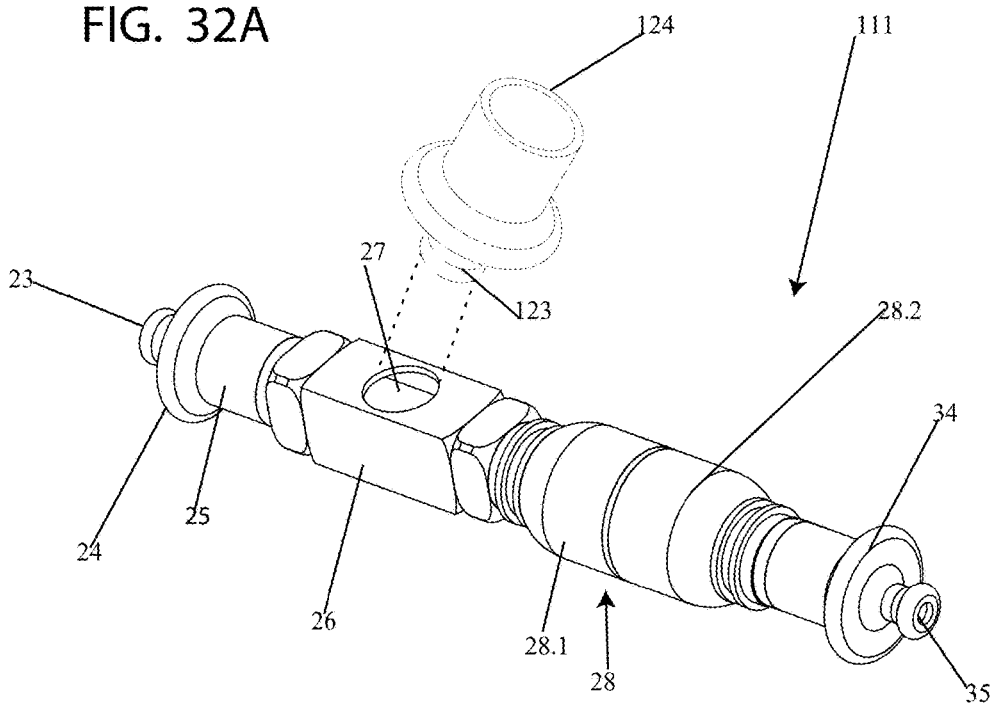
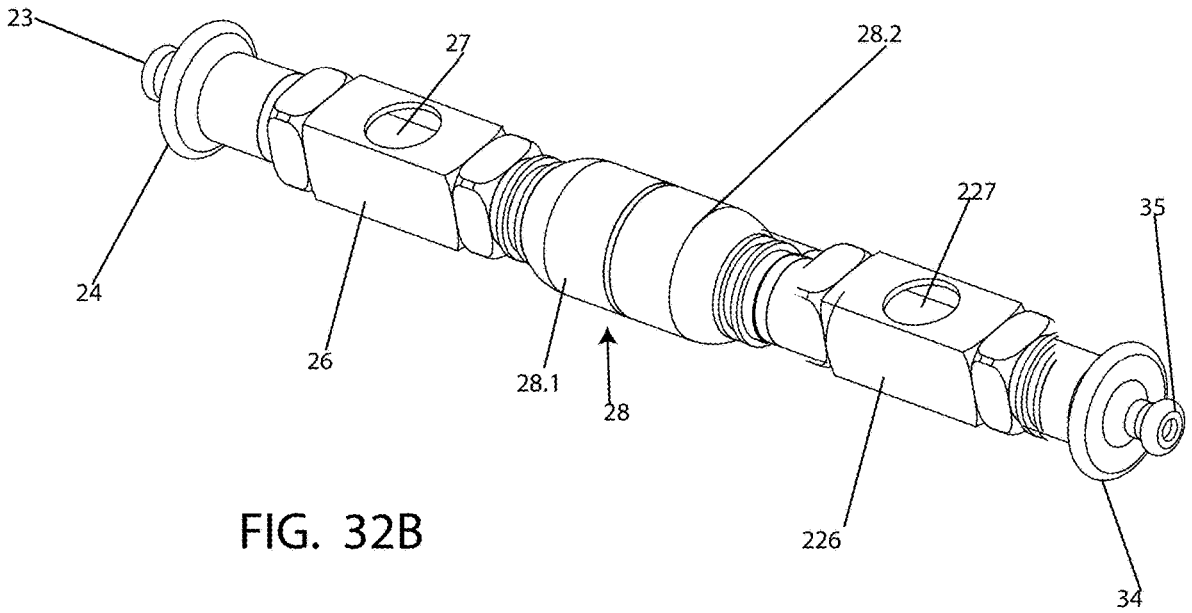
FIG. 32B

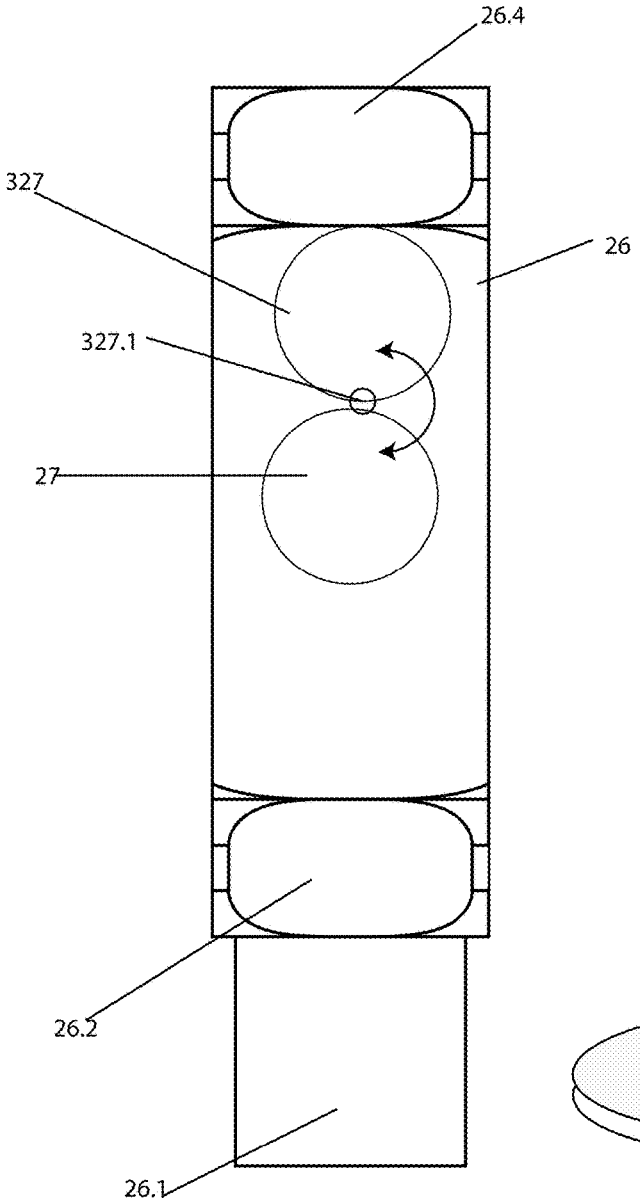
FIG. 35A
FIG. 35B
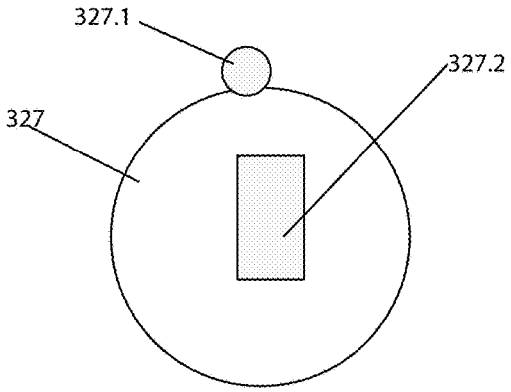
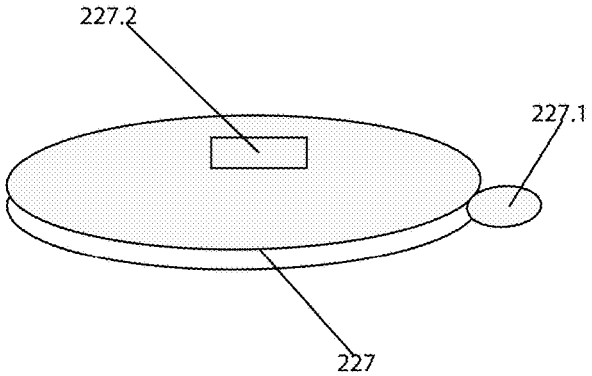
FIG. 35C

MODULAR SMOKING PIPE

CROSS REFERENCE TO RELATED APPLICATIONS

This application is a non-provisional application of U.S. Patent Application Ser. No. 63/190,179, filed on May 18, 2021, the disclosure of which is hereby incorporated herein by reference in its entirety.

FIELD OF THE INVENTION

The present invention relates generally to a smoking pipe. More specifically, the present invention is a modular smoking pipe that utilizes forced air from a pump to further enhance the inhalation experience associated with use of a smoking pipe being it of any materials, brass, copper, plastic, pvc or any other materials that allow forced air to keep any tobacco substance ignited.

BACKGROUND OF THE INVENTION

In present society, there has been an increasing acceptance of the use of smoking apparatuses, like smoking pipes, where users can inhale a variety of different products ranging from medicinal herbs to recreational drugs. However, with most smoking apparatuses, the user is not able to reap fully the full benefits of inhalation products because these apparatuses leave the act of inhalation solely on the user; meaning, the user is left responsible to try to inhale as much of the substance as the user possibly can.

However, it can be humanly impossible to inhale these substances at full strength repeatedly each time without wasting the inhalable parts of those substances. Because of this limitation, it can also be difficult for the user to achieve the benefits (acquired from inhalation of those substances previously mentioned) as quickly as possible. Another issue with most smoking apparatuses is the need for smoking papers or rolling paper, which is used to contain the inhalable/smokable substance before it is ignited and burned for inhalation. These papers, and the method of use associated with them, can make for a messy or unhygienic means of smoking and thus lead to an even less enjoyable inhalation session for the user. An additional issue with most smoking apparatuses is the near constant need to repeatedly re-ignite the substance manually during an inhalation session, which further prolongs the time it would take for the user to achieve or receive the benefits associated with inhalation of said substances. Another issue with most smoking apparatuses is the inability or difficulty in stowing and transporting said apparatuses.

Additionally, most smoking apparatuses have a singular purpose or a singular mean of use; meaning, certain smoking apparatuses can only be operated in a singular and particular manner.

An objective of one embodiment of the present invention is to provide users with a device that can be a modular smoking pipe. At least one embodiment of the present invention intends to provide users with a device that contains a plurality of components that are modular and can be arranged in various ways in order to be operated in a variety of manners. The present invention intends to provide users with a device that can force inhalation for the user or make it easier for the user to fully inhale at their most optimal. The present invention intends to provide users with a device that eliminates the need for rolling paper to be used for the smoking/inhalation session. At least one embodiment of the present invention intends to provide users with a device that continually keeps the smoking substance ignited without the need for the user to manually ignite the substance repeatedly. At least one embodiment of the present invention intends to provide users with a device that is lightweight and/or portable and which is easy to configure.

SUMMARY OF THE INVENTION

At least one embodiment of the present invention is a modular smoking pipe. At least one embodiment primarily contains a smoking pipe, an air pump, and a face mask. The smoking pipe is connected to the air pump on one end and is connected to the face mask on the other end. The smoking pipe contains modular components that can be re-arranged or removed depending on the method of use preferred by the user. The smoking pipe contains a mouthpiece at both ends of the smoking pipe. The smoking pipe contains an ignition port connected at one end to one of the mouthpieces nearer to the rear end of smoking pipe and connected to the pipe bowl at the other end. The pipe bowl is connected to a centerpiece at an end that is not connected to the ignition port. The centerpiece is connected to a stem at an end that is not connected to the centerpiece. The stem is connected to the mouthpiece nearer to the front end of the smoking pipe at an end that is not connected to the centerpiece.

BRIEF DESCRIPTION OF THE DRAWINGS

FIG. 18A is a perspective view of the three-way connector for ignition;

FIG. 18B is a perspective view of a four-way connector for ignition;

FIG. 32A is a side top perspective view of another embodiment of the invention;

FIG. 32B is a side top perspective view of another embodiment of the invention;

FIG. 35A is a top view of another embodiment of the invention;

FIG. 35B is a top view of the cover plate shown in FIG. 34;

FIG. 35C is a side perspective view of the cover plate shown in FIG. 34;

DETAILED DESCRIPTION

All illustrations of the drawings are to be describing selected versions of the present invention and are not intended to limit the scope of the present invention. All references of user or users pertain to either individual or individuals who would utilize the present invention.

Figure 1:
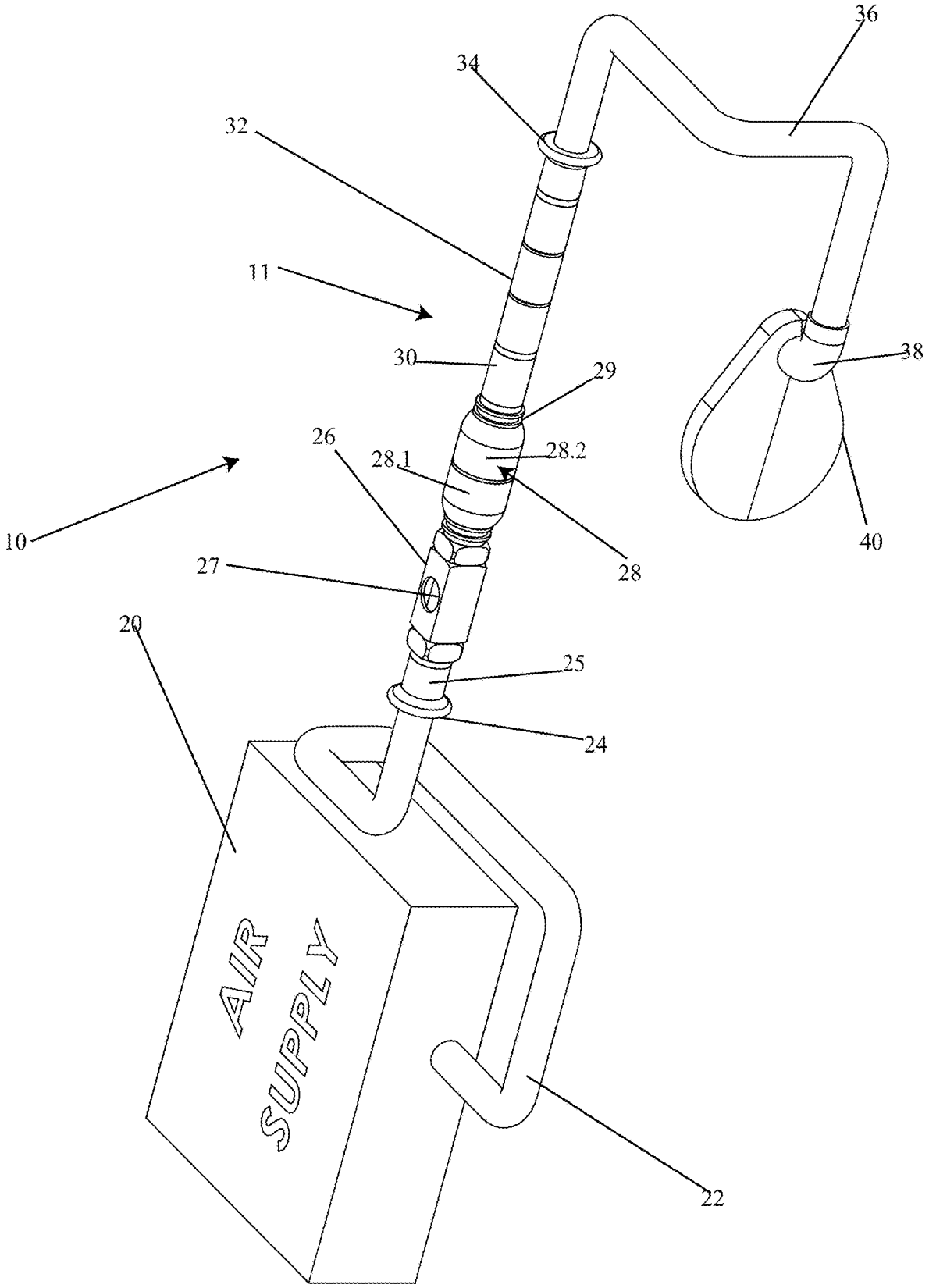
FIG. 1 is a front perspective view of the present invention.
Figure 2:
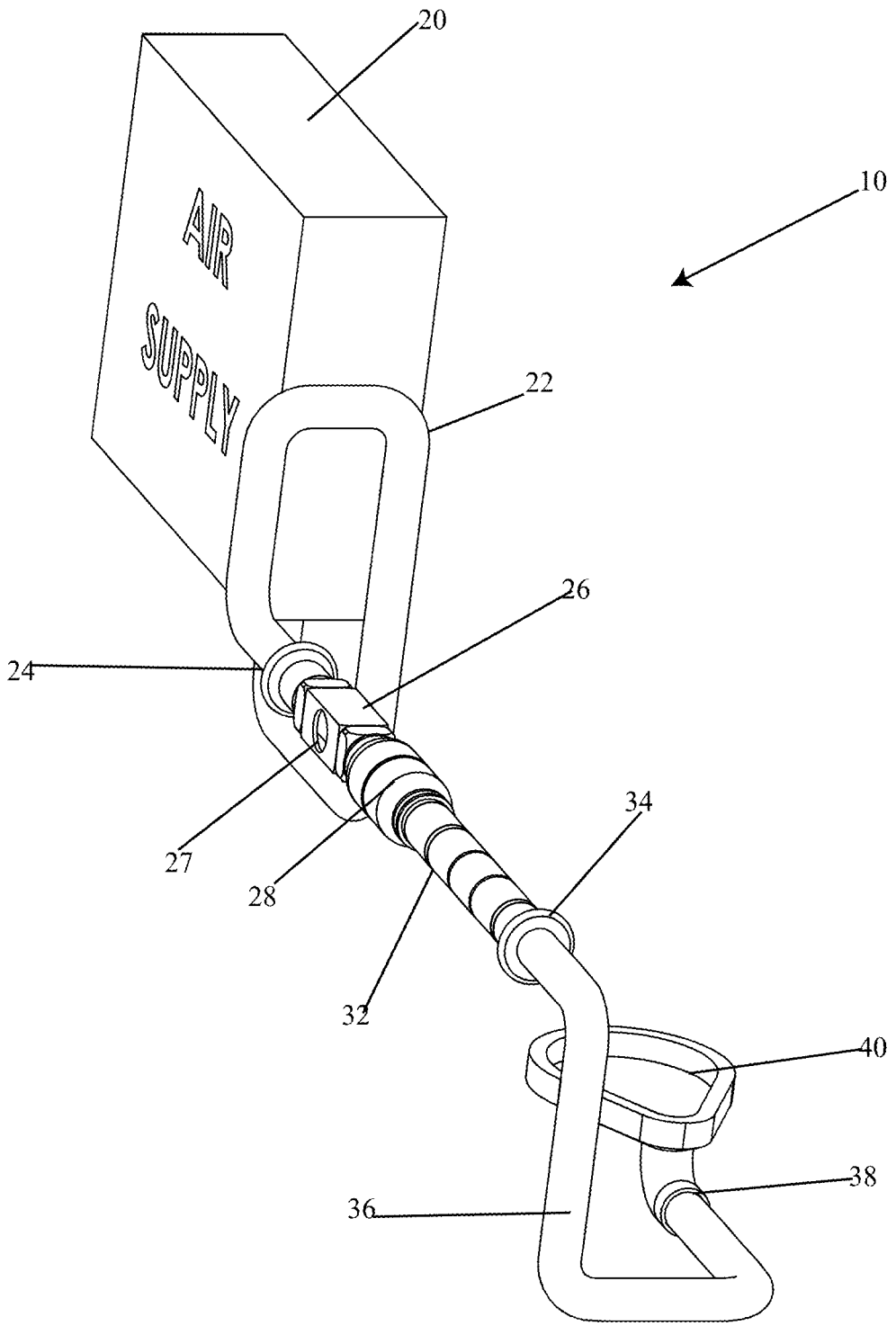
FIG. 2 is a rear perspective view of the present invention.

As seen in FIG. 1 through FIG. 2, there is a first embodiment 10 that is a modular smoking pipe 11. This embodiment 10 can be of any shape, size, material, features, type or kind, orientation, location, quantity, components, and arrangements of components.

This embodiment 10 can be made from a material that is strong, durable, wear-resistant, rust-resistant, tough, medical-grade, easily cleanable, easily manufacturable, insulation-effective, non-toxic, and/or leak-proof. This embodiment 10 comprises a face mask 40, an air pump 20, and a smoking pipe 11. Extending from the pump 20 is tube or shaft 22 which extends to first mouthpiece 24.

The pipe 11 includes a first mouthpiece 24 and a second mouthpiece 34 disposed on the opposite end of the pipe. The portion of the pipe between the two mouthpieces 24 and 34 is the body section. Extending from first mouthpiece 24 is a mouthpiece shaft 25. Coupled to the mouthpiece shaft 25 is an ignition housing 26 which contains an ignition port 27. Ignition housing 26 is in this embodiment, a three-port housing having an input coupled to the mouthpiece shaft 25, an ignition port 27 and an output coupled to a bowl adapter 28. Bowl adapter 28 includes a first bowl adapter portion 28.1 and a second bowl adapter 28.2. Each of these bowl adapters are semi-spherical or cup shaped and are configured to be selectively screwed together or fitted together to form a singular bowl adapter 28. The output of bowl adapter 28.2 is coupled to centerpiece 30. Centerpiece 30 is configured as a tubular or cylindrical shaped centerpiece which couples the ignition housing 26 to the stem 32. Stem 32 extends to second mouthpiece 34. Stem 32 is cylindrical in shape and has a hollow center. Coupled to second mouthpiece 34 is tube 36. Tube 36 is coupled to mask 40. Thus, pump 20 pumps air which flows from one end through the pipe 11 and into the face mask 40.

Face mask 40 can be of any shape, size, material, features, type or kind, orientation, location, quantity, components, and arrangements of components that would allow this embodiment to fulfill the objectives and intents of the at least one embodiment of the present invention. However, it can be preferred that the face mask 40 be connected to the end of the second mouthpiece 34 of the smoking pipe 11 by means of a tubing 36 or similar object that can facilitate for the passage of gas, smoke, or similar objects. It can be preferred that face mask 40 be of the type or kind such that the user can inhale gas, smoke, or similar object as it is being exhaust outward from the end of the second mouthpiece 34 of the smoking pipe 11.

As seen in FIG. 1 through FIG. 2, the present invention contains an air pump 20. The air pump 20 can be of any shape, size, material, features, type or kind, orientation, location, quantity, components, and arrangements of components that would allow the present invention to fulfill the objectives and intents of the present invention. However, it can be preferred that the air pump 20 be of a material similar to and/or compatible with present invention. It can be preferred that the air pump 20 be connected to the end of the first mouthpiece 24 of the smoking pipe 11 by means of a tubing or shaft 22 or similar object that can facilitate the passage of gas, smoke, and other similar objects. It can be preferred that the air pump 20 be of a type or kind such that the air pump 20 can generate and/or supply air through the smoking pipe 11 to the user via the face mask 40. Such types or kinds can include, but is not limited to, the following: mechanical air pumps, hand air pumps, air compressors, and other similarly related objects.

As seen in FIG. 1 through FIG. 7, the present invention contains a smoking pipe 11. The smoking pipe 11 can be of any shape, size, material, features, type or kind, orientation, location, quantity, components, and arrangements of components that would allow this embodiment to fulfill the objectives and intents of at least one embodiment of the present invention. It can be preferred that the smoking pipe 11 be of a shape or figure that is hollow. It can be preferred that the smoking pipe 11 be of an overall length that is significantly greater than the overall diameter of the smoking pipe 11. The smoking pipe 11 primarily includes a first mouthpiece 24, a second mouthpiece 34, an ignition port 27, a pipe 11, bowl 28, a centerpiece 30, and a stem 32. It can be preferred that the components of the smoking pipe 11 be arranged in a linear manner along a longitudinal axis 11*a* (See FIG. 7) with a washer-like object between each of the components. It can also be preferred that the components of the smoking pipe 11 be connected to one another by means of mechanical fasteners-like features such as threads and similarly related objects.

As seen in FIG. 3 through FIG. 12, the smoking pipe 11 contains a first mouthpiece 24. The first mouthpiece 24 can be of any shape, size, material, features, type or kind, orientation, location, quantity, components, and arrangements of components that would allow the present invention to fulfill the objectives and intents of the present invention.

Figure 9:
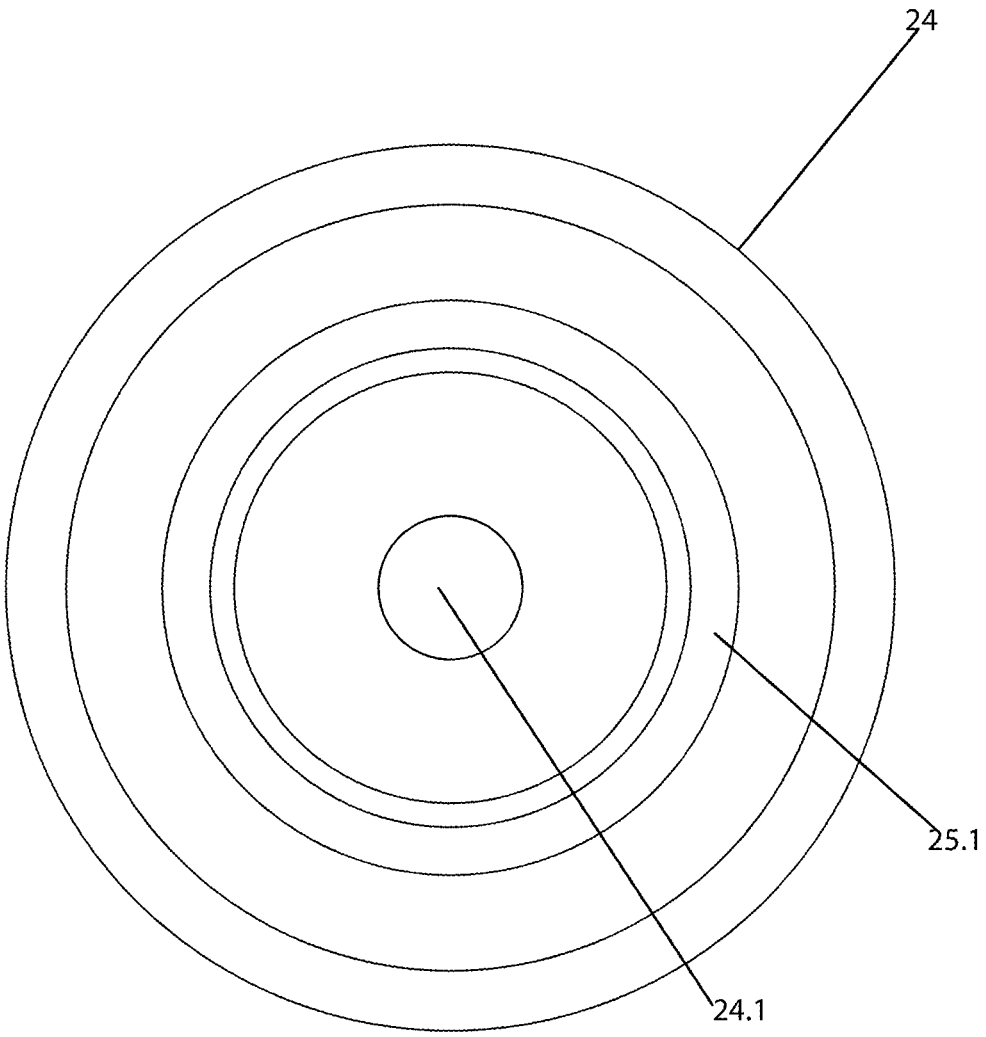
FIG. 9 is a right-side view of the mouthpiece.
Figure 10:
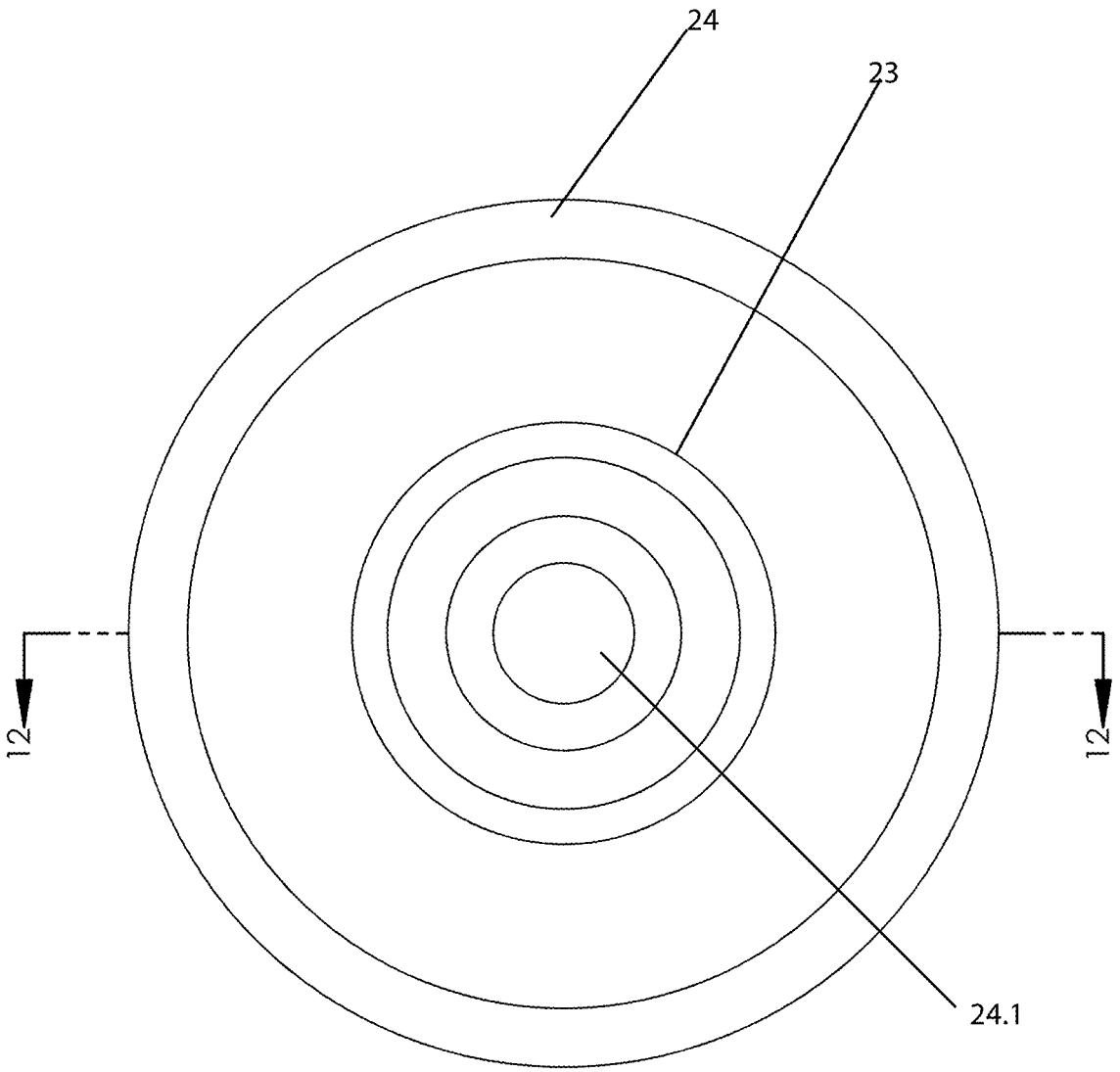
FIG. 10 is a left side view of the mouthpiece.

However, it can be preferred that the first mouthpiece 24 be of a material similar to and/or compatible with the material of the smoking pipe 11. It can be preferred that the first mouthpiece 24 be of a shape, size, features, type or kind, and/or components such that the user can places their lips or mouth around the tip of the first mouthpiece 24. It can be preferred that the first mouthpiece 24 be hollowed. It can be preferred that the first mouthpiece 24 is connected to the air pump 20 by the tip of the first mouthpiece 24 and is connected to an end of the ignition port 27 by the end of the first mouthpiece 24 opposite from the tip of the first mouthpiece 24, as illustrated in FIG. 1 and in FIG. 4; respectively. It can be preferred that the first mouthpiece 24 contain a first channel that is located centrally along the axis of the first mouthpiece 24, as illustrated in FIG. 9 through FIG. 10 and in FIG. 12. It can be preferred that the first channel be of a length similar to length of the first mouthpiece 24. It can be preferred that the first channel be of a diameter slightly smaller than the diameter of the tip of the first mouthpiece 24.

Figure 3:
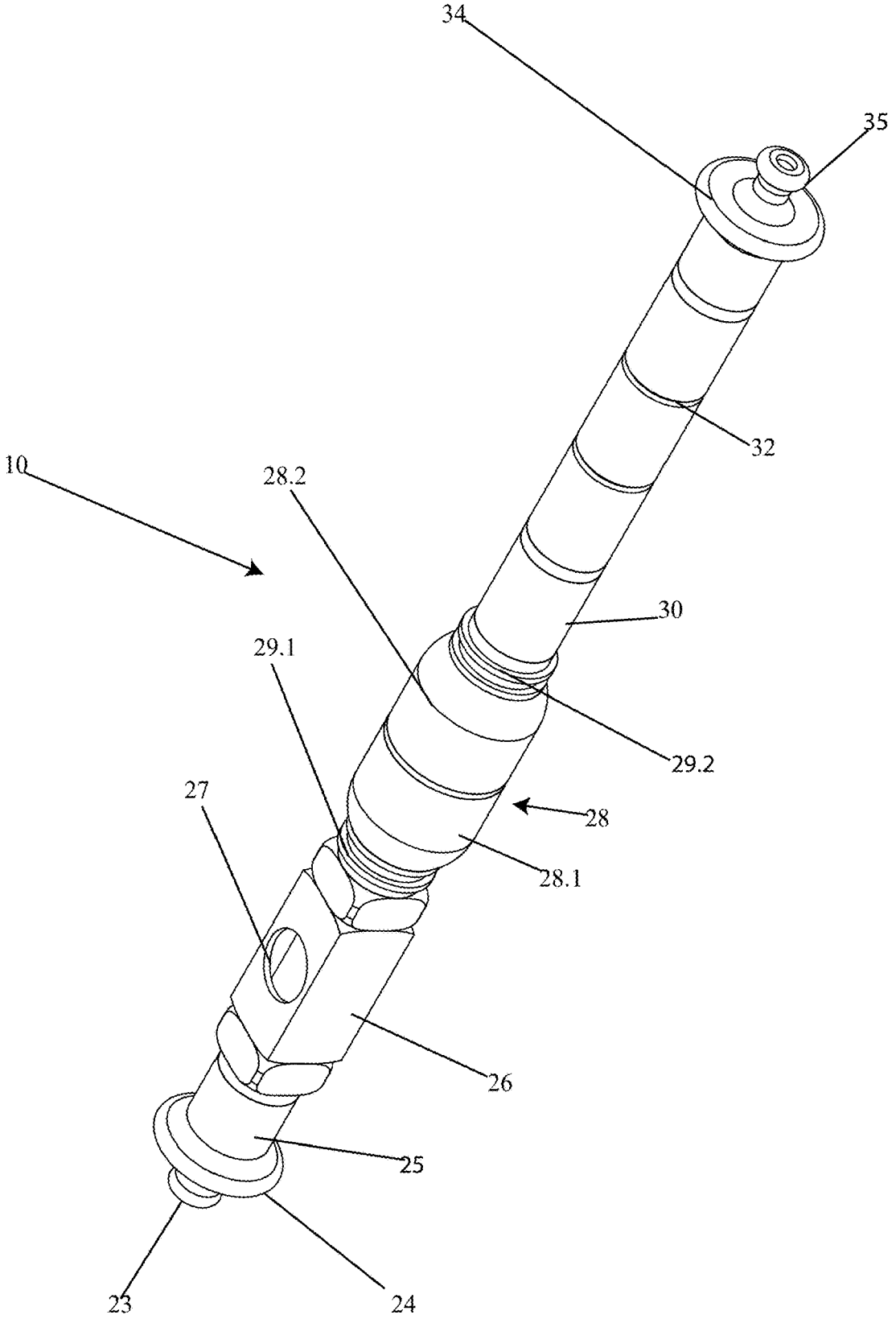
FIG. 3 is a perspective view of the smoking pipe.
Figure 4:
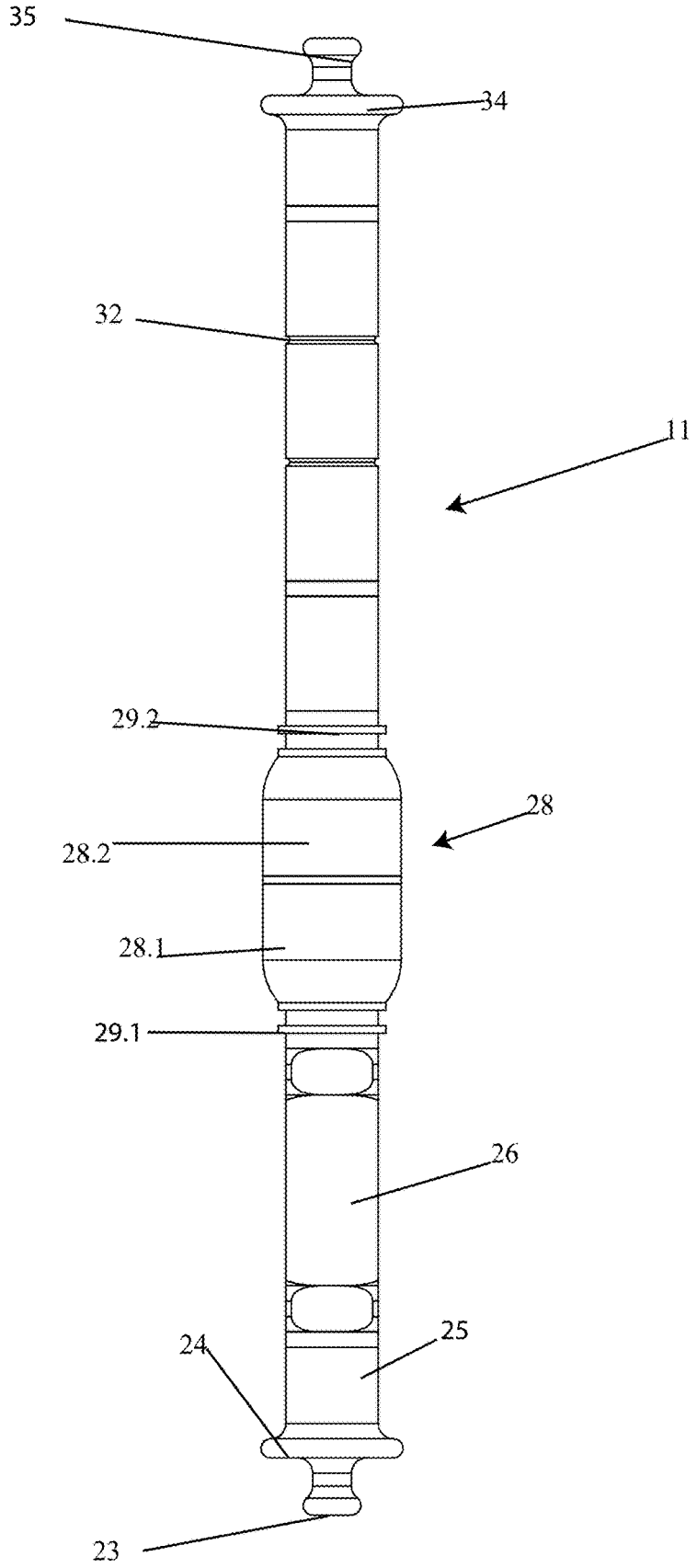
FIG. 4 is a front/rear view of the smoking pipe.

As seen in FIG. 3 through FIG. 12, the smoking pipe 11 contains a second mouthpiece 34. The second mouthpiece 34 can be of any shape, size, material, features, type or kind, orientation, location, quantity, components, and arrangements of components that would allow the present invention to fulfill the objectives and intents of the present invention. However, it can be preferred that the second mouthpiece 34 be identical to the first mouthpiece 24 It can be preferred that the second mouthpiece 34 is connected to the face mask 40 by the tip of the second mouthpiece 34 and is connected to an end of the stem 32 by the end of the second mouthpiece 34 opposite from the tip of the second mouthpiece, as illustrated in FIG. 1 and in FIG. 4; respectively. For example, as shown in FIGS. 3 and 4 which show a perspective view and a side view respectively, there is shown a first mouthpiece 24 having a tip 23. First mouthpiece 24 has a mouthpiece shaft 25 which is coupled to the input of ignition housing 26. Ignition housing 26 is coupled to bowl 28. Bowl 28 has an input connection end 29.1 and an output connection (or downstream) connection end 29.2. Downstream connection end 29.2 is coupled to centerpiece 30. Centerpiece is coupled to stem 32. The output of centerpiece 30 feeds into stem 32 wherein the output of stem 32 feeds into second mouthpiece 34.

Figure 5:
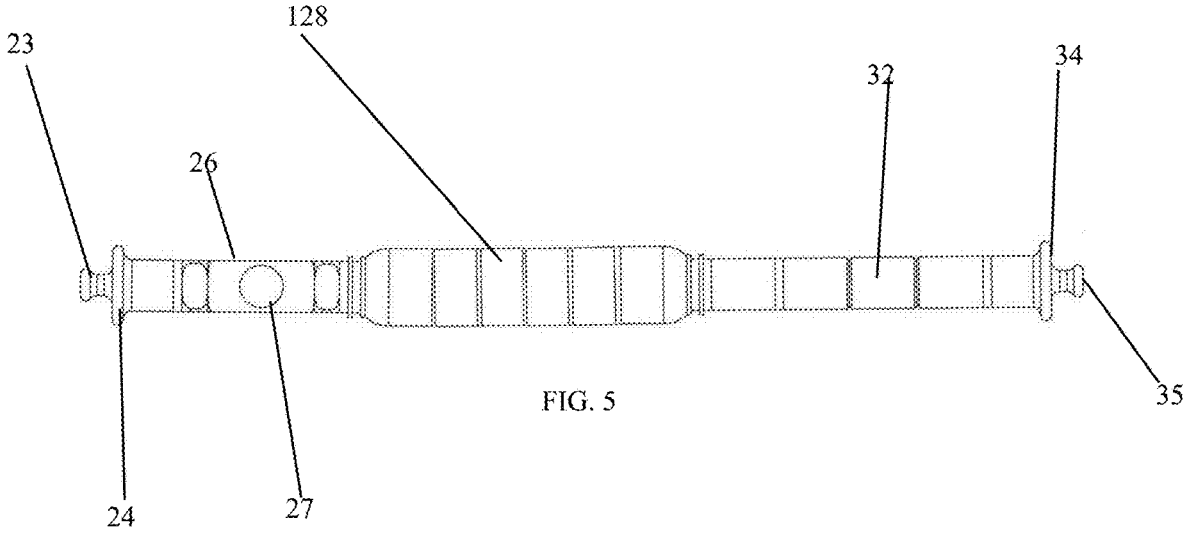
FIG. 5 is a top view of the smoking pipe having an extended bowl.

FIG. 5 of this embodiment includes an extended bowl 128 which is longer than the standard bowl 28. This extended bowl 128 is of such a length that this allows for the insertion of a rolled cigarette or joint to be housed therein. Thus, with this embodiment, there is a first mouthpiece 24 having a tip 23. This mouthpiece has a shaft 25 which is coupled to ignition housing 26. Ignition housing 26 has a third port 27 for receiving a flame. Coupled to a second port of ignition housing 26 is a bowl 128. This bowl 128 is longer than bowl. Coupled to an output of bowl 128 is a centerpiece 30. Centerpiece 30 is coupled to a stem 32. Stem 32 is adaptable and can be extended if necessary. Coupled to an output of stem 32 is second mouthpiece 34 having tip 35.

Figure 6:
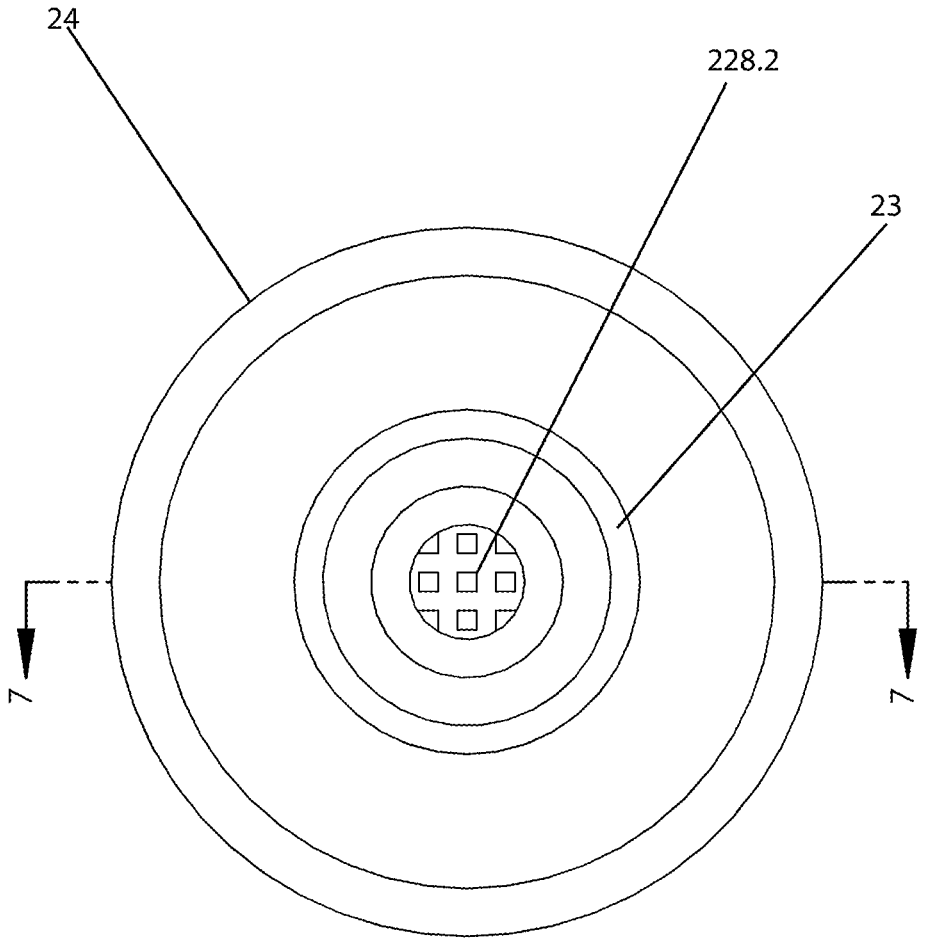
FIG. 6 is an end view of the smoking pipe.
Figure 21:
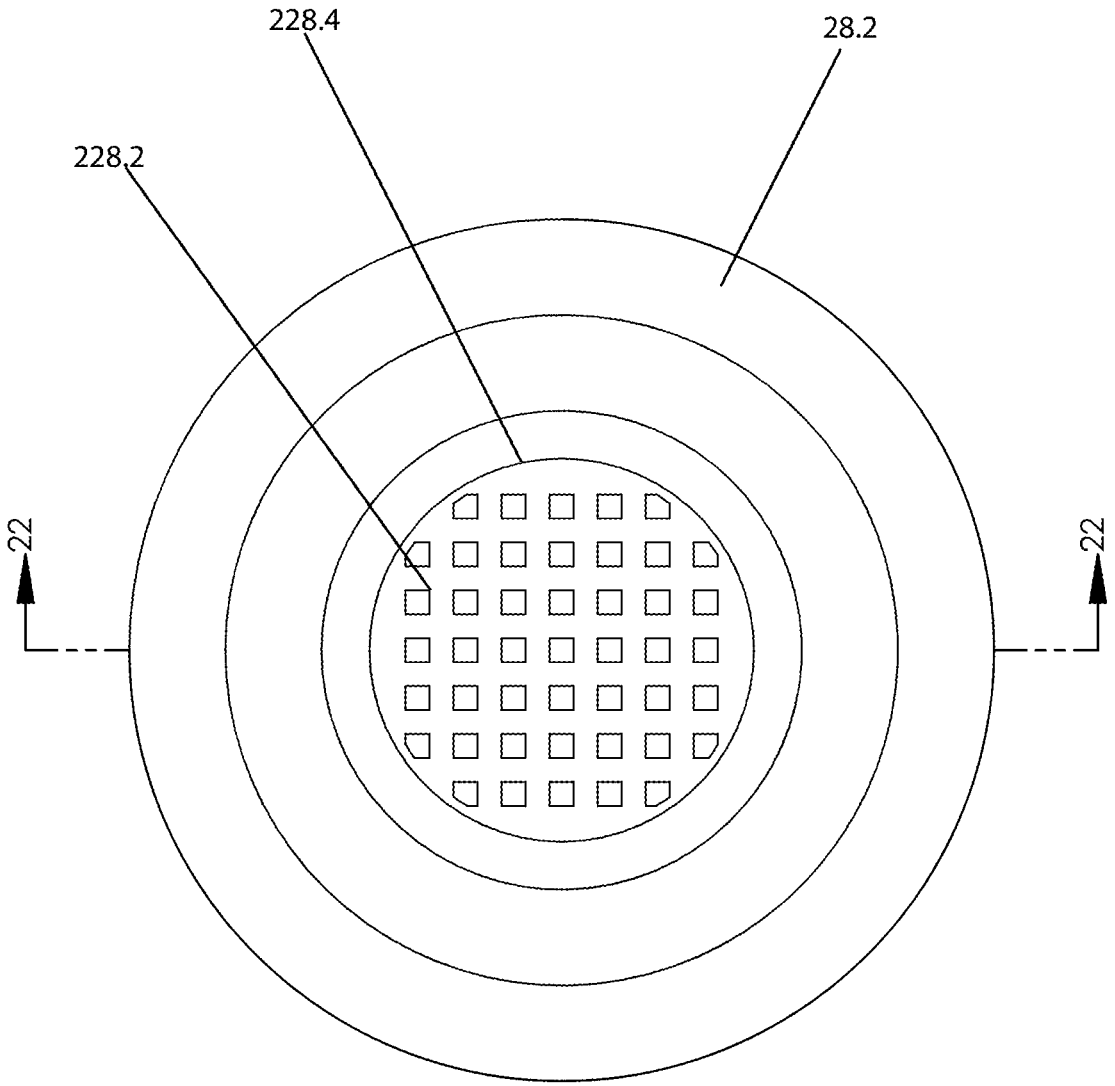
FIG. 21 is a side view of a pipe bowl.

In particular FIG. 6 is an end view of the embodiment 10 which shows mouthpiece 24, tip 23 and grate 228.2 which is disposed downstream from the tip 23 (see FIG. 21).

Figure 7:
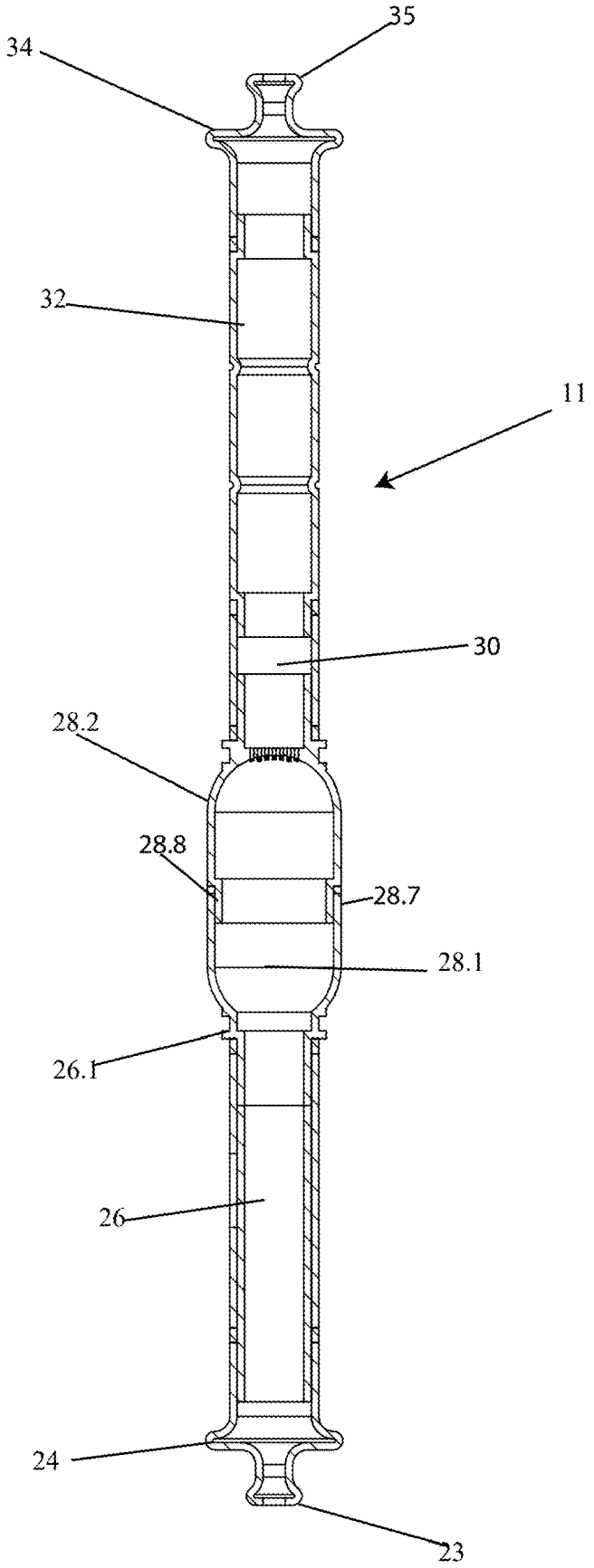
FIG. 7 is a cross-sectional view of the smoking pipe taken along line 7-7 in FIG. 6.

As seen in FIG. 3 through FIG. 7 and in FIG. 13 through FIG. 17, the smoking pipe 11 contains an ignition port 27 located in the ignition housing. The ignition port 27 can be of any shape, size, material, features, type or kind, orientation, location, quantity, components, and arrangements of components that would allow the present invention to fulfill the objectives and intents of the present invention. However, it can be preferred that the ignition port 27 be of a material similar to and/or compatible with the material of the smoking pipe 11. It can be preferred that the ignition port 27 be of a shape similar to a hollow, cylindrical-like shaped figure. The ignition port 27 primarily contains a rod or ignition housing and a three-way connector. The rod can be of any shape, size, material, features, type or kind, orientation, location, quantity, components, and arrangements of components that would allow the present invention to fulfill the objectives and intents of the present invention. However, it can be preferred that the rod be of a material similar to and/or compatible with the material of the ignition port 27. It can be preferred that the rod or ignition housing be of a shape similar to a hollow, open-ended, and cylindrical like shaped figure. It can be preferred that the rod be of an outer diameter similar to the inner diameter of the second channel. It can be preferred that the rod be of an inner diameter that is slightly smaller than the outer diameter of the rod. It can be preferred that the rod be inserted into the or through the second channel of the three-way connector. Thus, air or fluid flows from tip 23 through to tip 35 through an extended hollow cylinder (See FIG. 7) which shows the hollow extension of tip 23, mouthpiece 24, mouthpiece shaft 25, bowl 28 (having female bowl end 28.1 and male bowl end 28.2. Fluid or air flows through bowl 28 and into centerpiece 30 through stem 32 and then through mouthpiece 34 and through tip 35 which can then be into a person's mouth. The bowl 28 is configured to house smokeable material. As shown in FIG. 7, bowl 28.1 has a female outer cylinder 28.7 and male bowl end 28.2 has a male outer cylinder 28.8.

Figure 8:
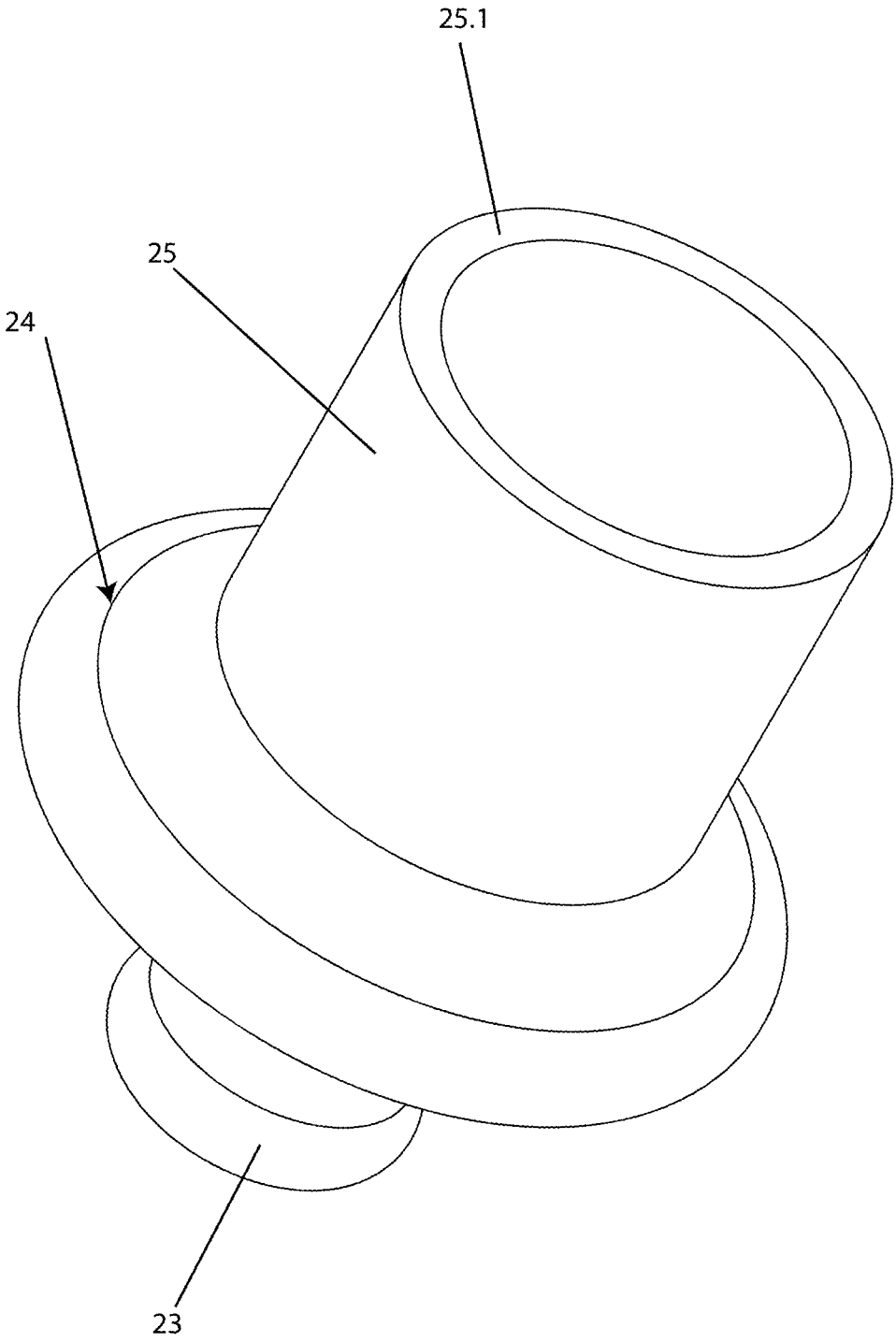
FIG. 8 is a perspective view of the mouthpiece.

FIG. 8 is a perspective view of the mouthpiece 24 having a tip 23 and a mouthpiece shaft 25 as well as an open end 25.1.

Figure 11:
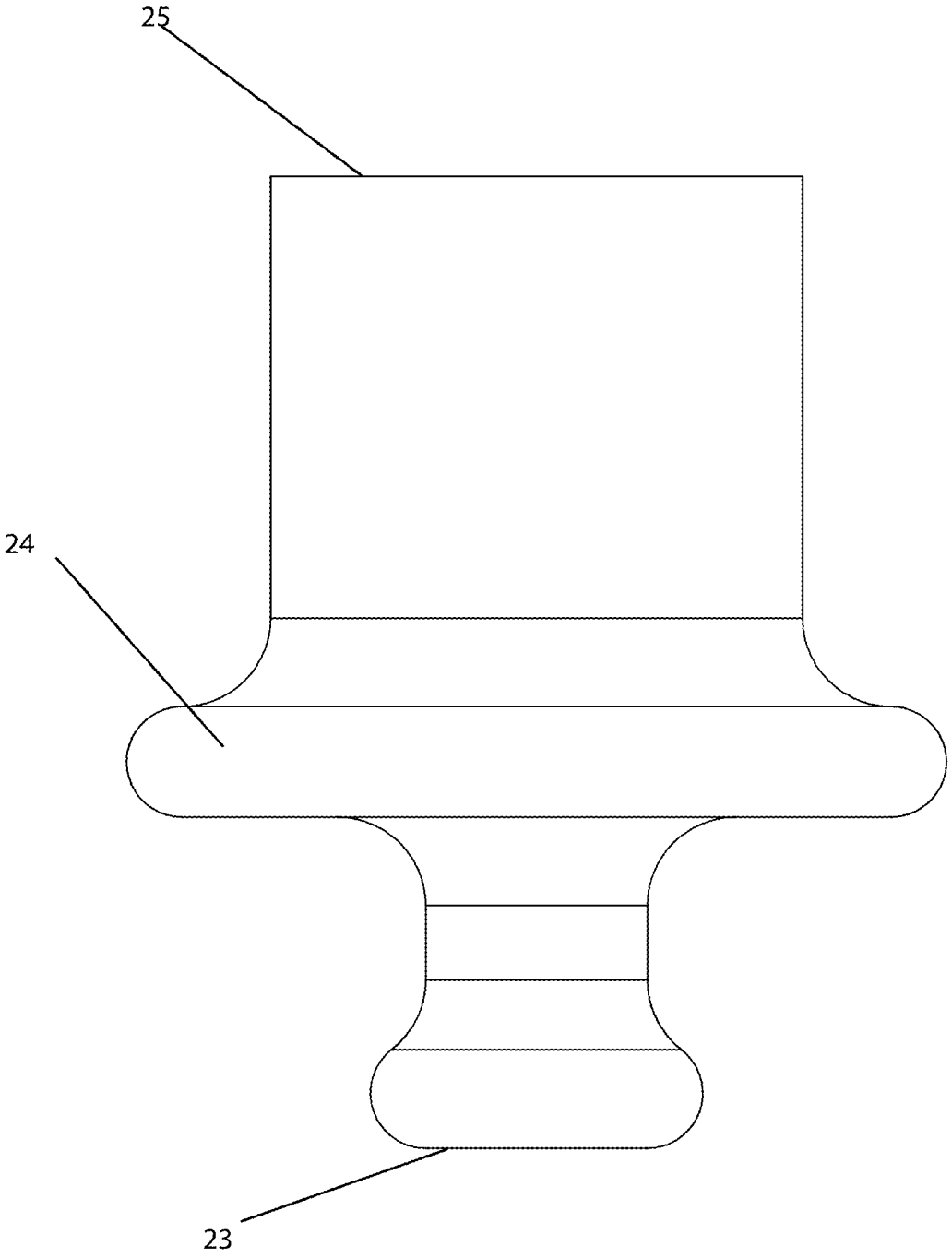
FIG. 11 is a front/rear or top/bottom view of the mouthpiece.
Figure 12:
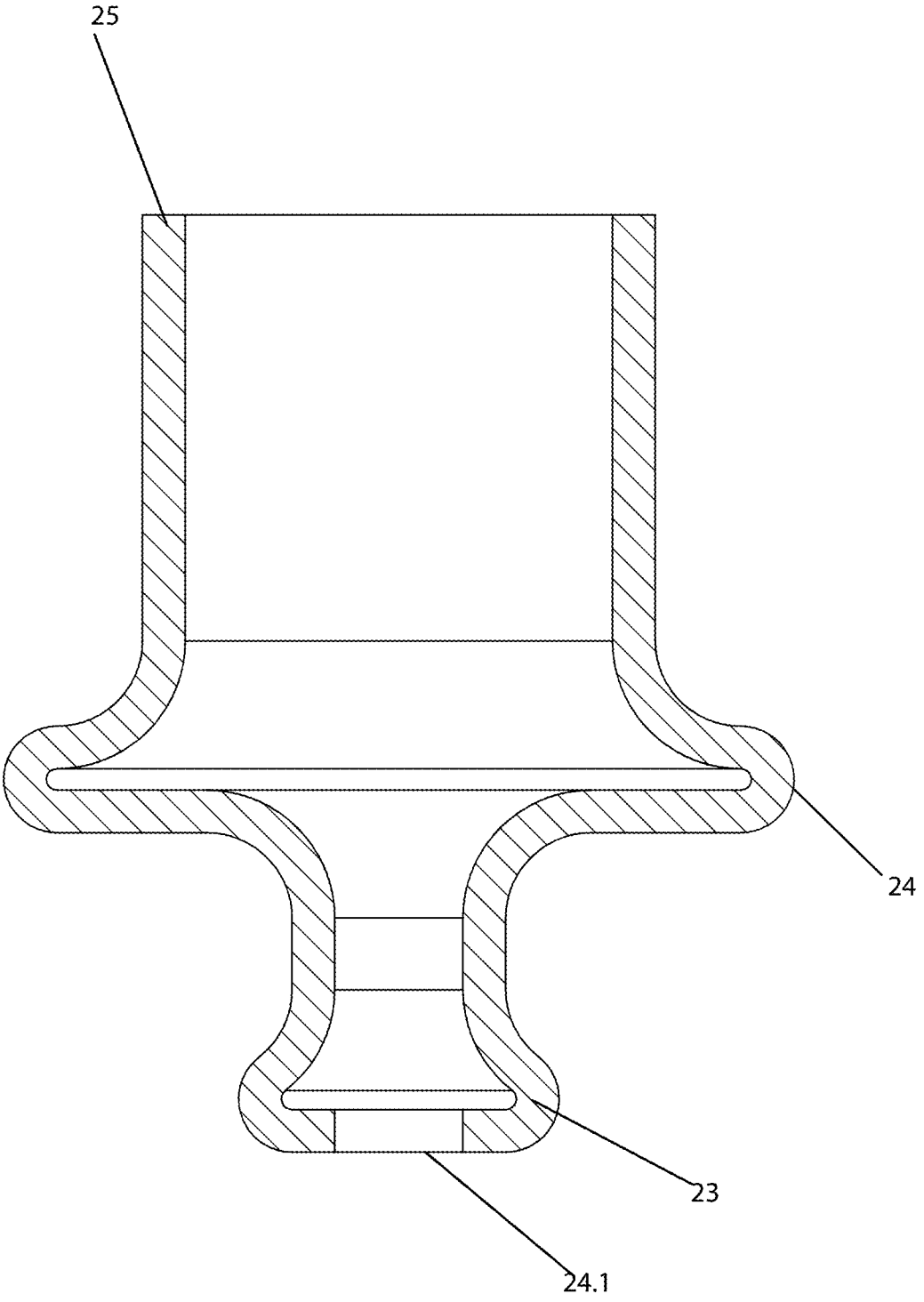
FIG. 12 is a cross-sectional view of the mouthpiece taken along line 12-12 in FIG. 10.
Figure 13:
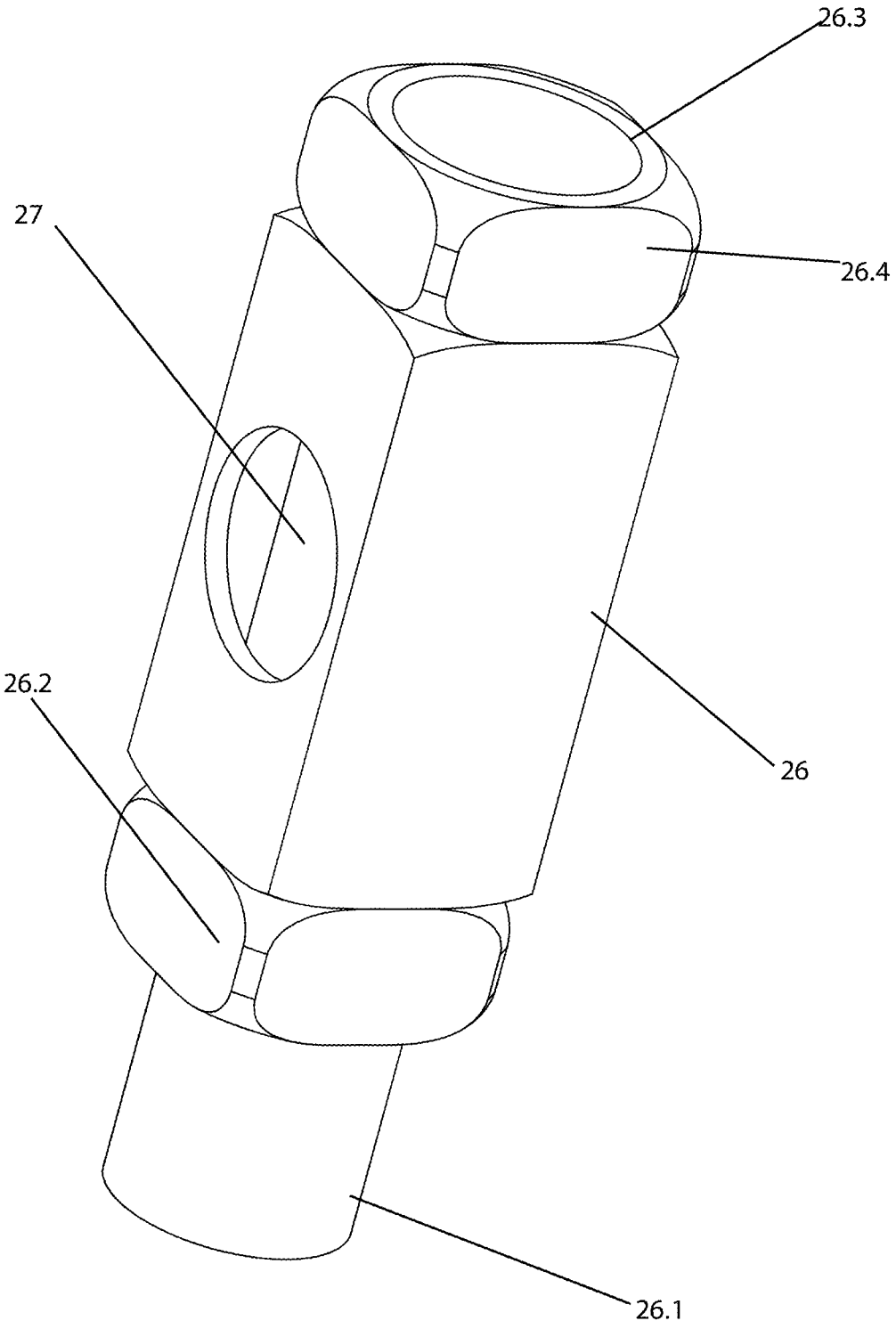
FIG. 13 is a perspective view of the ignition port.
Figure 14:
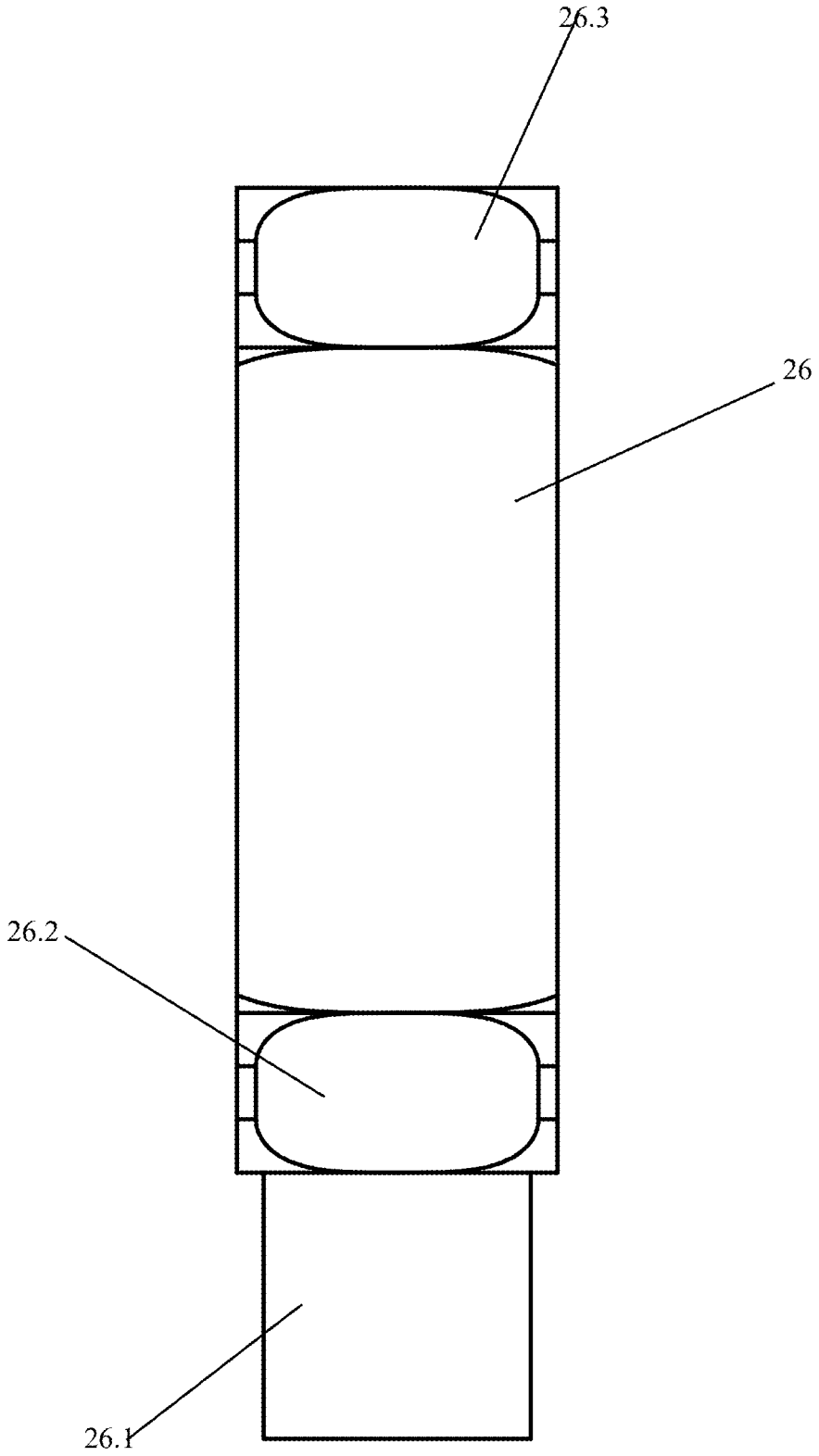
FIG. 14 is a bottom view of the ignition port.

FIG. 9 is an end view of mouthpiece 24 having a tip 23 a central hole 24.1 which allows air or other fluids to pass therethrough and which doesn't have a screen such as the screen shown in FIG. 6. FIG. 10 shows this end view which shows mouthpiece 24 having tip 23 and central hole 24.1. FIG. 11 shows a side view of this mouthpiece 24 which has shaft 25 and tip 23. The tip 23 is formed from a parabolically shaped curved end forming tip 23 which bows out. FIG. 12 shows a side cross sectional view of this mouthpiece 24 showing shaft 25, mouthpiece 24 and tip 23 with opening 24.1.

As seen in FIG. 13 through FIG. 18A, the ignition port 27 is part of an ignition housing 26 that contains a three-way connector. The three-way connector can be of any shape, size, material, features, type or kind, orientation, location, quantity, components, and arrangements of components that would allow the present invention to fulfill the objectives and intents of the present invention. However, it can be preferred that the three-way connector be of a material similar to and/or compatible with the material of the ignition port. It can be preferred that the three-way connector be of a shape and size similar to the shape and size of the ignition port. The three-way connector primarily contains a first channel end or opening 26.1 positioned adjacent to a larger channel body section 26.2 which is surrounded by a nut section 26.5. (See FIG. 14). There is a second channel end or opening 26.3 and a third channel or ignition port 27. The first channel end or opening 26.1 and the second or distal end channel end or ignition port or opening 26.3 can be of any shape, size, material, features, type or kind, orientation, location, quantity, components, and arrangements of components that would allow the present invention to fulfill the objectives and intents of the present invention.

Figure 15:
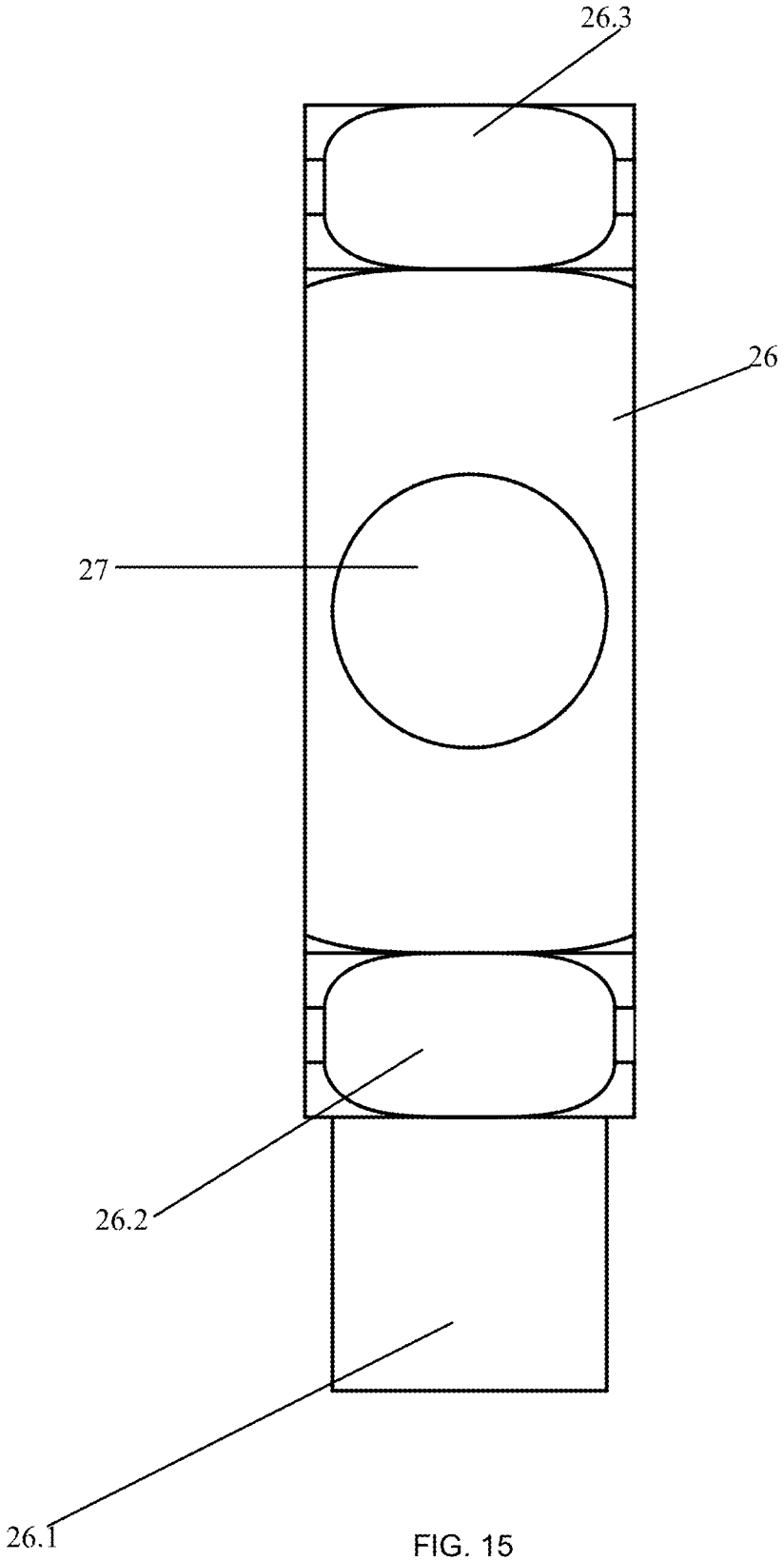
FIG. 15 is a top view of the ignition port.

However, it can be preferred that the second channel end or opening 26.3 be located centrally on a side face of the three-way connector or ignition housing 26. It can be preferred that the second channel 26.3 be of a depth similar to the length of the three-way connector. It can be preferred that the second channel port 26.3 be of a diameter similar to the diameter of the first channel port 26.1 or third channel or ignition port 27 (See FIG. 15). FIG. 15 shows a top view of the ignition housing 26

The third channel or ignition port 27 can be of any shape, size, material, features, type or kind, orientation, location, quantity, components, and arrangements of components that would allow the present invention to fulfill the objectives and intents of the present invention. However, it can be preferred that the third channel or ignition port 27 located centrally on the top face of the three-way connector. It can be preferred that the third channel or ignition port 27 be of a diameter similar to the diameter of the first tail of the female bowl or the second tail of the male bowl. It can be preferred that the third channel or ignition port 27 be of a depth similar to half of the height of the three-way connector.

Figure 16:
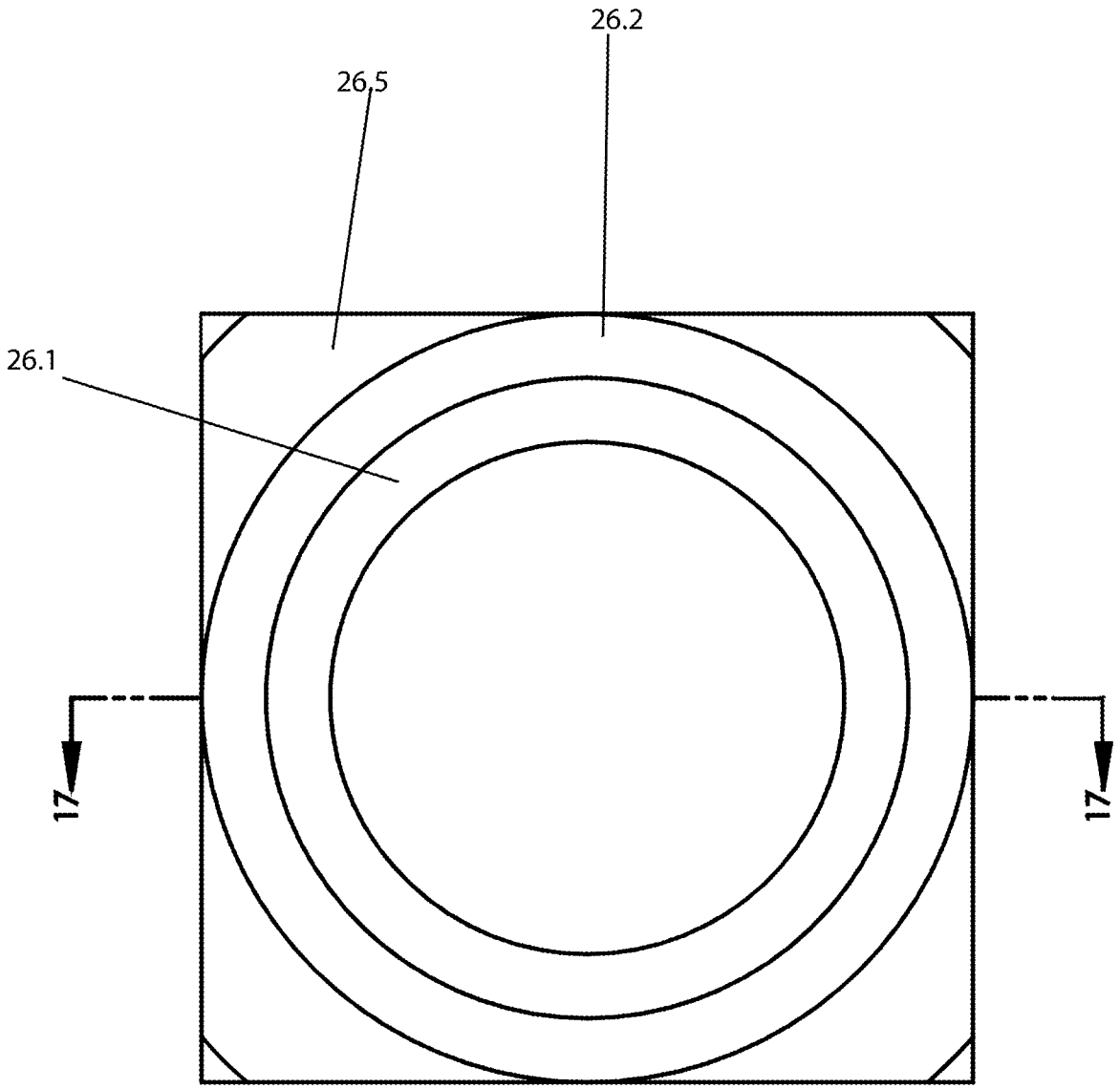
FIG. 16 is a side view of the ignition port.

FIG. 16 shows an end view of this ignition housing 26 which shows channel end or opening 26.1 surrounded by a larger channel body section 26.2 and a nut or fastening section 26.5.

Figure 17:
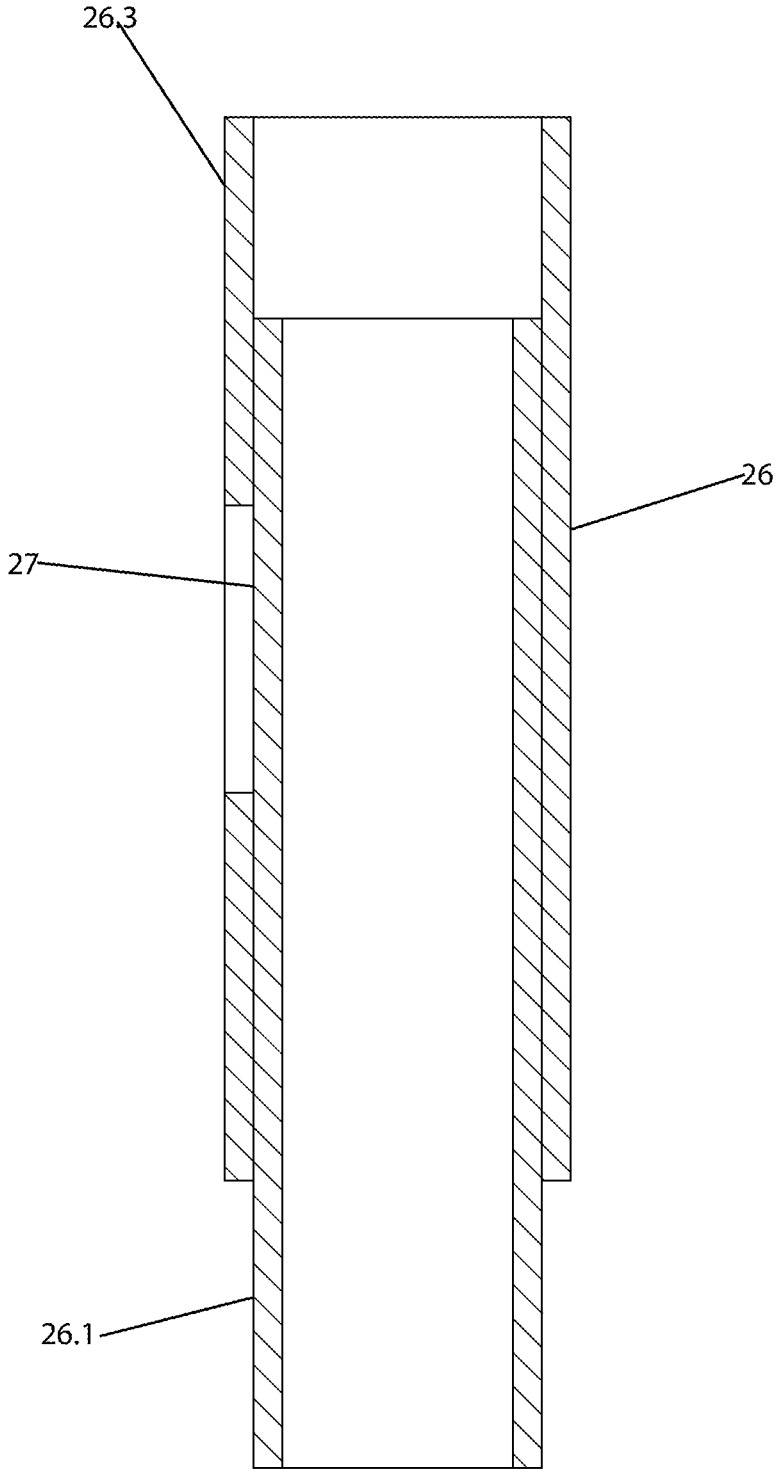
FIG. 17 is the cross-sectional view of the ignition port taken along line 17-17 in FIG. 16.

FIG. 17 shows a cross-sectional view taken along line 17-17 which shows port 27 positioned in ignition housing 26 along with first channel port 26.1, second channel port 26.3 as well as third channel port 27, with first channel port 26.1 being spaced opposite second channel port 26.3 along longitudinal axis line 26L.

FIG. 18A shows a perspective view of the ignition housing 26 which shows second channel or port 26.3, nut 26.4, in ignition housing 26. Port 27 is shown with an opening similar in size to second channel or port 26.3. This view also shows channel body section 26.2 and nut 26.5 thereby forming a three-way connector with three separate ports.

FIG. 18B is another embodiment of the invention wherein in this view there is a four channel or four opening ignition housing 126. This ignition housing includes flattened edges or nuts 126.2 and 126.3 at each end of the ignition housing. In addition, there are openings 126.4 and 126.5 at either end of the longitudinal axis 126L of this ignition housing. There are also two separate ports 127 and 227 spaced opposite each other along the latitudinal axis 127L. The latitudinal axis 127L is transverse to the longitudinal axis 126L.

Figure 19:
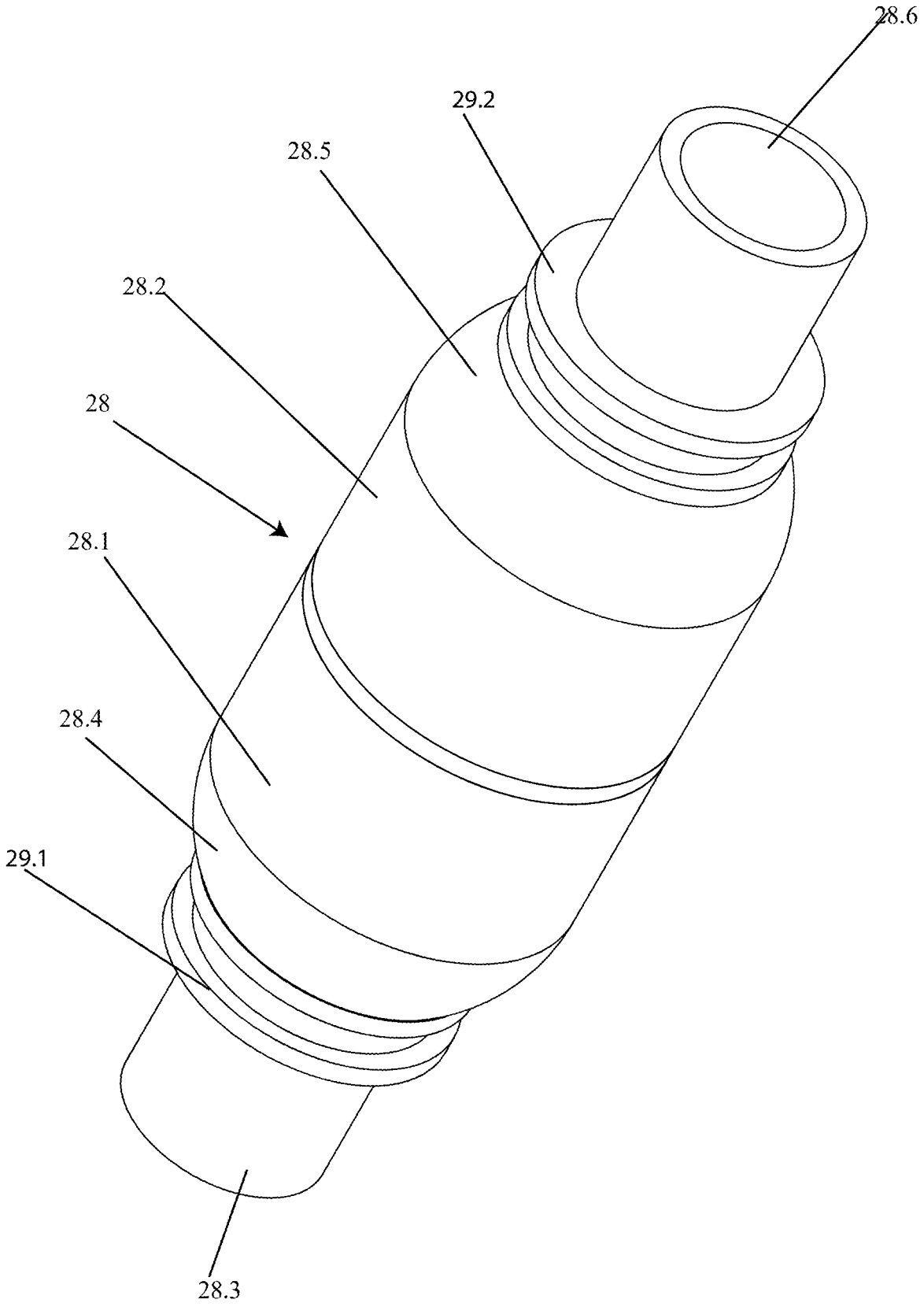
FIG. 19 is a perspective view of a pipe bowl.

As seen in FIG. 3 through FIG. 7 and in FIG. 19 through FIG. 22, the smoking pipe 11 contains a pipe bowl 28. The pipe bowl 28 can be of any shape, size, material, features, type or kind, orientation, location, quantity, components, and arrangements of components that would allow the present invention to fulfill the objectives and intents of the present invention. However, it can be preferred that the pipe bowl 28 be of a material similar to and/or compatible with the material of the smoking pipe. It can be preferred that the pipe bowl 28 be of an overall diameter not greater than the overall diameter of the smoking pipe. It can be preferred that the pipe bowl 28 be of a hollow, open-faced, and cylindrical-like shaped figure such that the user can load substances within the chamber of the pipe bowl 28. The pipe bowl 28 can primarily include a male bowl 28.2 and a female bowl 28.1 as shown in FIG. 19 which is a perspective view of these bowls.

Figure 20:
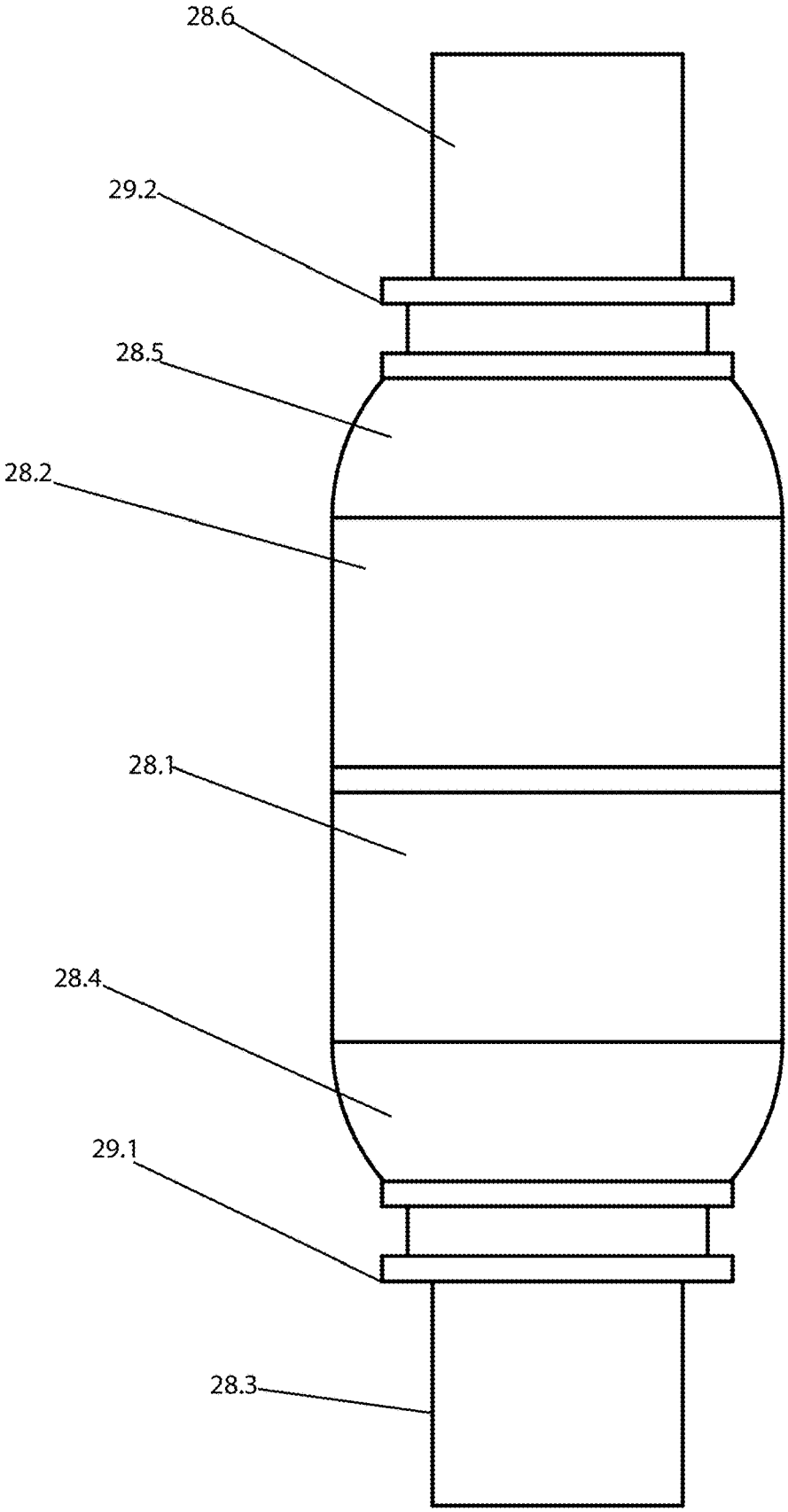
FIG. 20 is a front/rear or top/bottom view of a pipe bowl being it of any materials, brass; copper, plastic, pvc or any other materials that allow forced air to keep any tobacco substance ignited.
Figure 22:
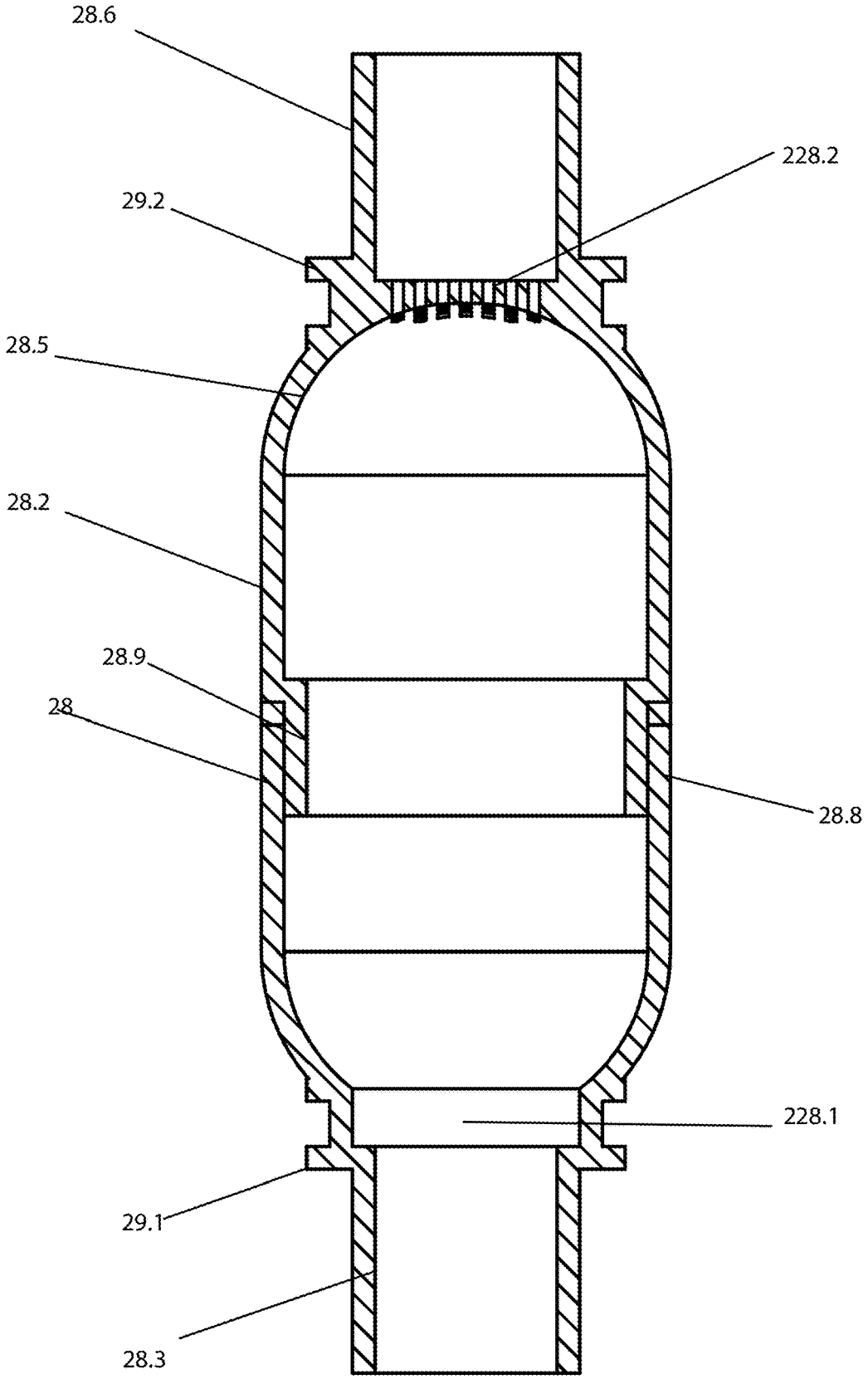
FIG. 22 is the cross-sectional view of the pipe bowl taken along line 22-22 in FIG. 21.

As seen in FIG. 19 through FIG. 24, the pipe bowl 28 contains a female bowl 28.1 and a male bowl 28.2 (See FIG. 20). The female bowl 28.1 can be of any shape, size, material, features, type or kind, orientation, location, quantity, components, and arrangements of components that would allow the present invention to fulfill the objectives and intents of the present invention. However, it can be preferred that the female bowl 28.1 be of a material similar to and/or compatible with the material of the pipe bowl 28. It can be preferred that the female bowl 28.1 be of a hollow (See FIGS. 22 and 23), open-faced, and cylindrical-like shaped figure similar to the shape of the pipe bowl 28. It can be preferred that the female bowl 28.1 contain a first tail 28.3. The first tail 28.3 can be of any shape, size, material, features, type or kind, orientation, location, quantity, components, and arrangements of components that would allow the present invention to fulfill the objectives and intents of the present invention. However, it can be preferred that the first tail 28.3 be of an outer diameter slightly smaller than the diameter of the end of the female bowl 28.1 opposite from the tail. It can be preferred that the tail 28.3 of the female bowl 28.1 be connected to the end 26.4 of the three-way connector or ignition housing 26 that is not connected to the first mouthpiece 24. It can be preferred that the other end of the female bowl be attached to the second tail of the male bowl 28.2 of the pipe bowl 28 being it of any materials, brass, copper, plastic, pvc or any other materials that allow forced air to keep any tobacco substance ignited. the pipe bowl 28 can primarily include a male bowl and a female bowl. FIG. 21 shows an end view of the bowl assembly 28 which shows grate or screen 228.2. FIG. 22 shows a cross sectional view of the bowl assembly 28 as well. This view shows that female bowl 28.1 has an opening 228.1 with rim 29.1. Male bowl 28.2 has an end with a shaft 28.6 which can be coupled to center 30 or stem 32 and has a screen 228.2 adjacent to a rim 29.2.

Figure 25:
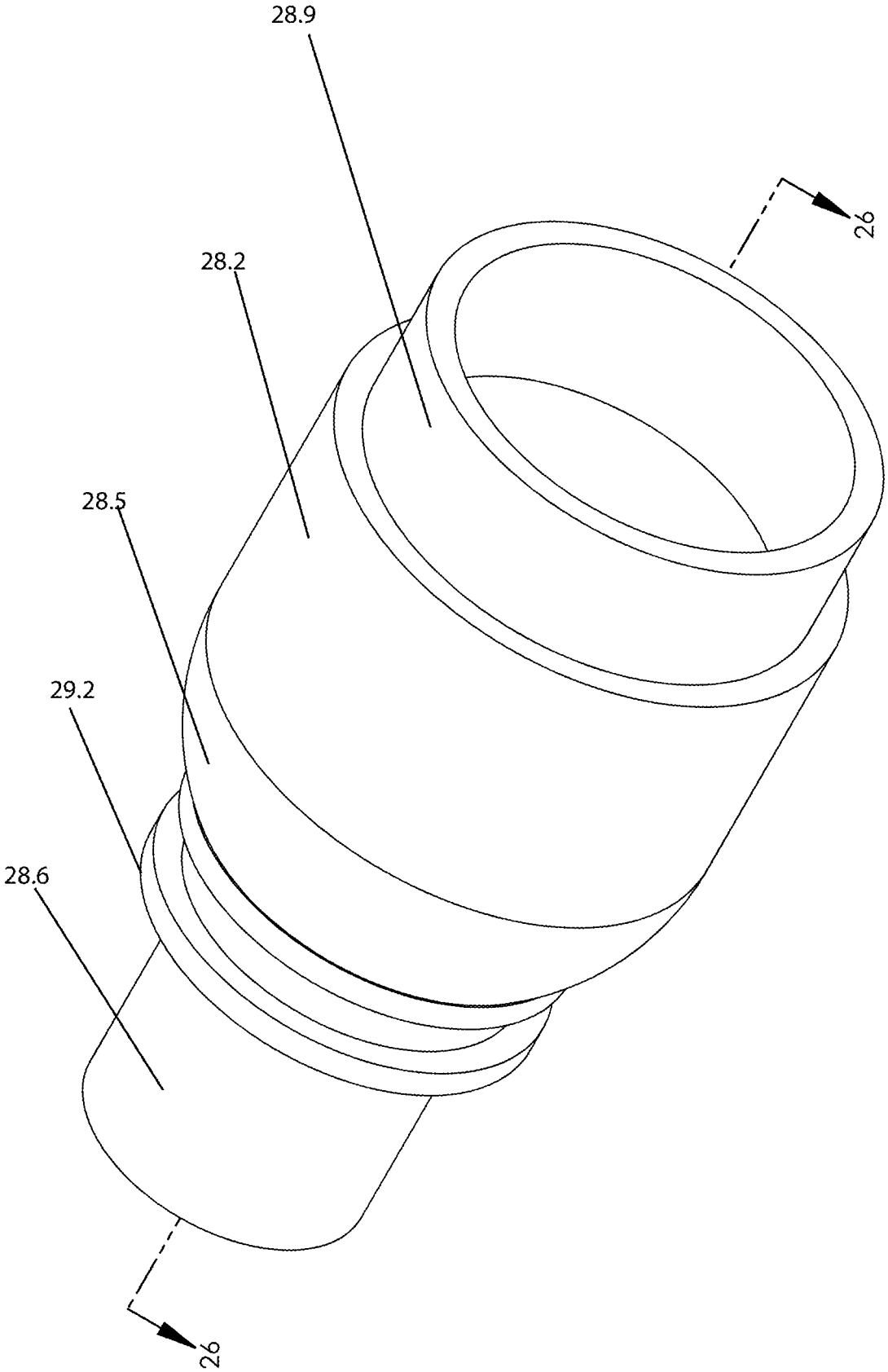
FIG. 25 is a perspective view of the male bowl.
Figure 26:
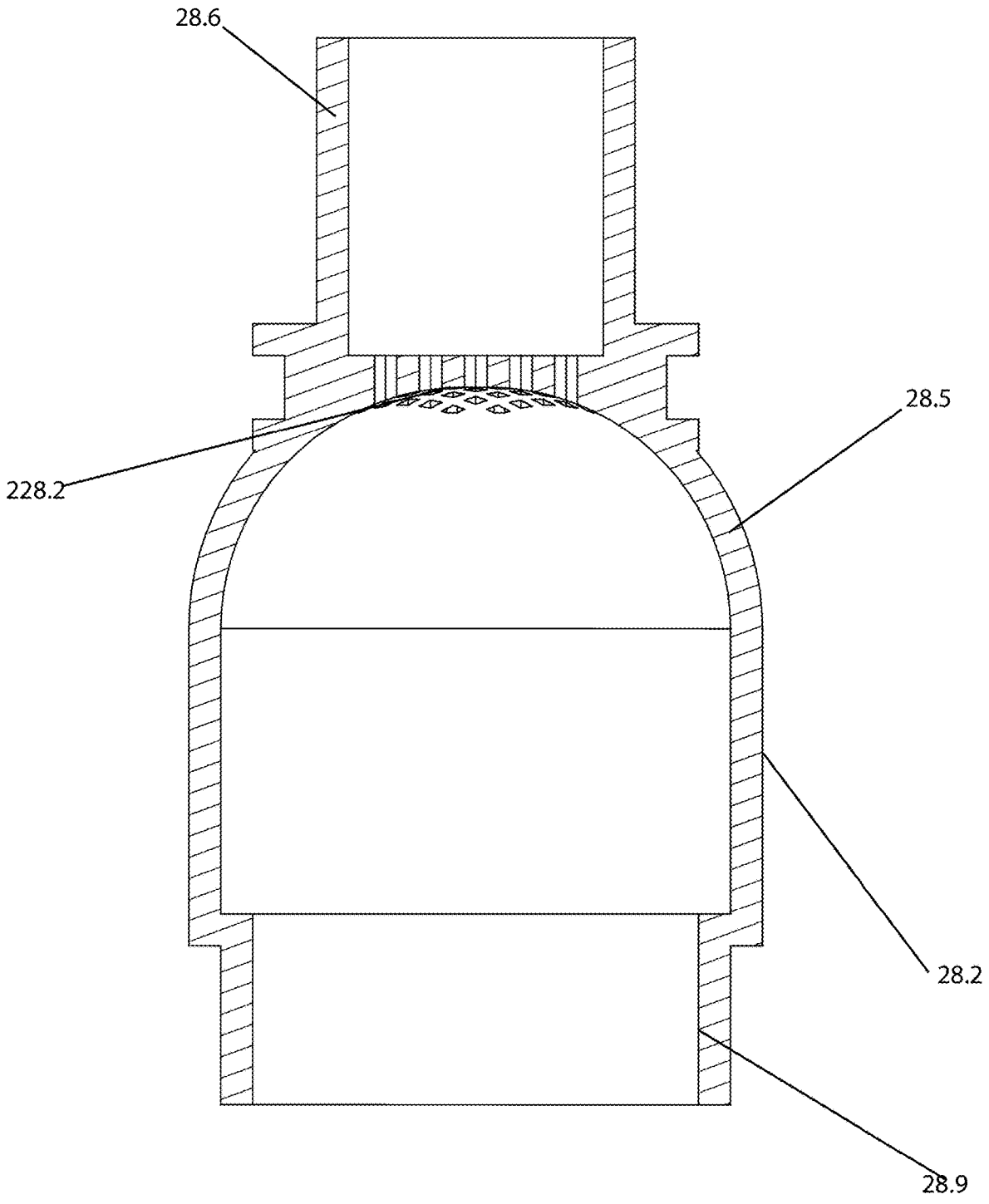
FIG. 26 is a cross-sectional view of the male bowl taken along line 26-26 in FIG. 25.

As seen in FIG. 19 through FIG. 22 and in FIG. 25 through FIG. 26, the pipe bowl 28 contains a male bowl 28.2. The male bowl 28.2 can be of any shape, size, material, features, type or kind, orientation, location, quantity, components, and arrangements of components that would allow the present invention to fulfill the objectives and intents of the present invention. However, it can be preferred that the male bowl be of a material similar to and/or compatible with the material of the pipe bowl 28. It can be preferred that the male bowl be of a shape, size, features, and/or components similar to the shape, size, features, and/or components of the female bowl. It can be preferred that the male bowl contain a second tail and a third tail. It can be preferred that the second tail be of any shape, size, material, features, type or kind, orientation, location, quantity, components, and arrangements of components that would allow the present invention to fulfill the objectives and intents of the present invention. However, it can be preferred that the second tail be similar to the first tail in shape, size, material, features, type or kind, orientation, quantity, components, and arrangements of components. It can be preferred that the second tail be located on the side face of the male bowl opposite from the location of the third tail. The third tail can be of any shape, size, material, features, type or kind, orientation, location, quantity, components, and arrangements of components that would allow the present invention to fulfill the objectives and intents of the present invention. However, it can be preferred that the third tail be located on the end of the male bowl that is connected to the female bowl and opposite from the location of the second tail. It can be preferred that the third tail be similar to the second tail in shape, size, material, features, type or kind, quantity, components, and arrangements of components. It is preferred that the second tail is connected to an end of the centerpiece.

It is preferred that the third tail is connected to the end of the female bowl that is not containing the first tail or not connected to the three-way connector. The male bowl 28.2 contains a screen 228.2. The screen 228.2 be of any shape, size, material, features, type or kind, orientation, location, quantity, components, and arrangements of components that would allow the present invention to fulfill the objectives and intents of the present invention.

However, it can be preferred that the screen 228.2 be of a type or kind such that particulate materials or similar cannot pass through the screen while allowing passage of smoke, gas, air and another similar object. As shown, in particular, in FIG. 21, the screen 228.2 sits inside of rim 228.4 and inside of male bowl 28.2.

FIG. 22 shows a side cross-sectional view of bowl 28, which includes female bowl 28.1 and male bowl 28.2. Female bowl 28.1 includes an outer sheath 28.8 while male bowl 28.2 includes an inner sheath 28.9. Female bowl 28.1 has a central hole 228.1 a first end shaft 28.3 and a rim 29.1. Male bowl 28.2 includes a rounded bowl section 28.5 a rim 29.2 and a screen 228.2 as well as a shaft section 28.6 which connects to the centerpiece 30.

Figure 23:
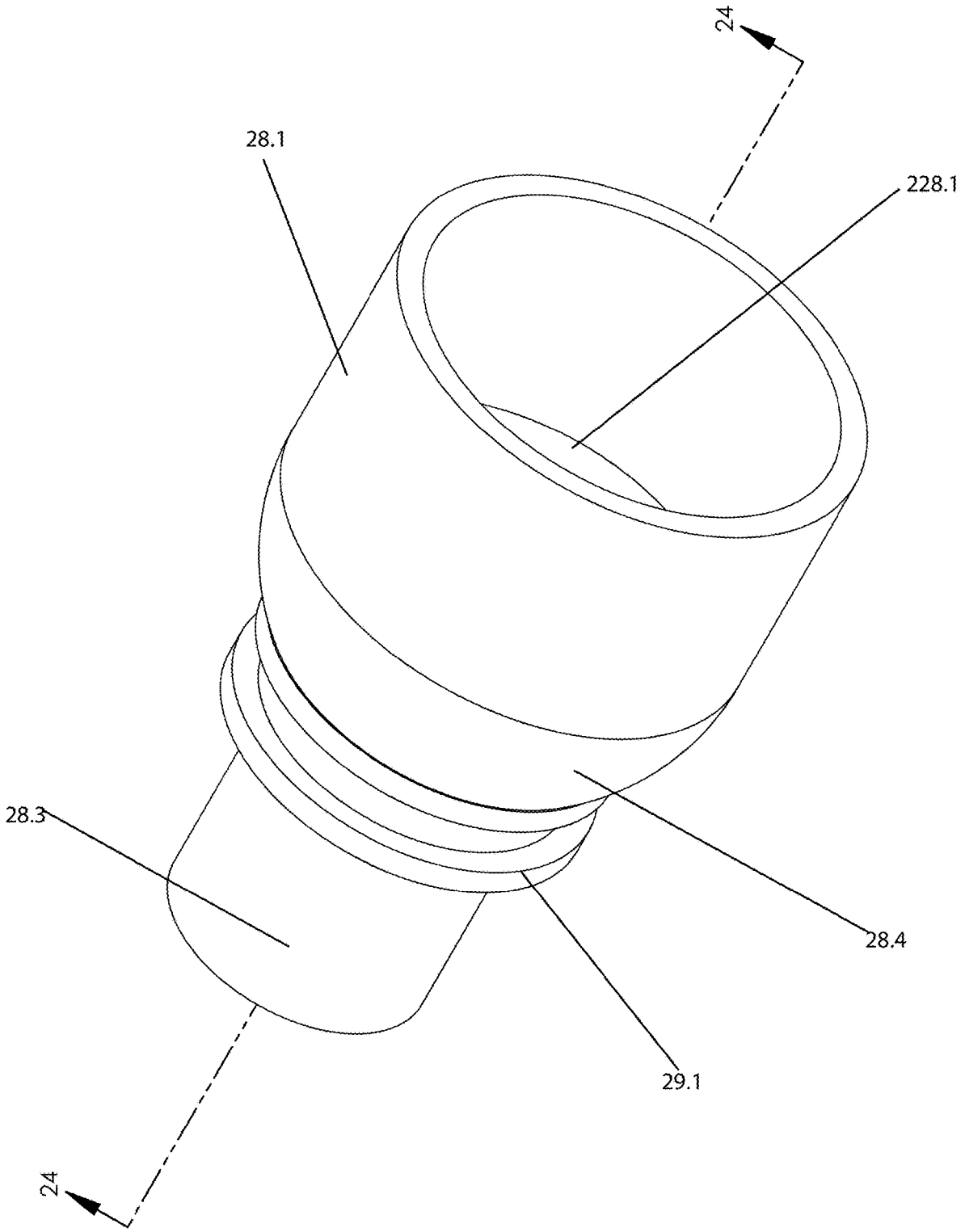
FIG. 23 is a perspective view of the female bowl.
Figure 24:
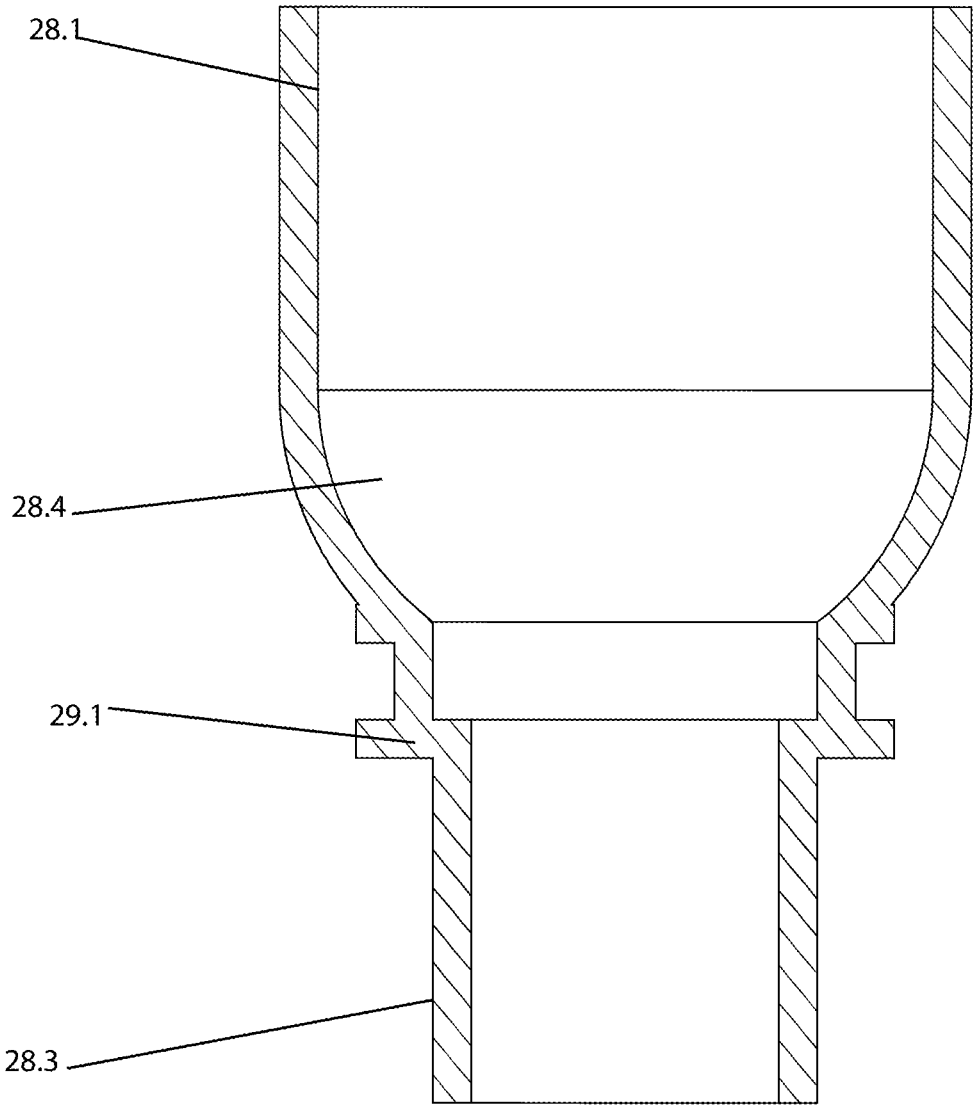
FIG. 24 is a cross-sectional view of the female bowl taken along line 24-24 in FIG. 23.

FIG. 23 shows a perspective view of bowl 28.1 which has a central passage 228.1 as well as a bowl section 28.4. There is a rim 29.1, and a shaft 28.3 for this portion. FIG. 24 shows a side cross-sectional view of female bowl 28.1 which shows bowl or curved section 28.4 as well as rim 29. Shaft 28.3 is shown extending out from bowl 28.4.

FIG. 25 shows a perspective view of male bowl 28.2 which shows inner sheath 28.9 extending indented from the remainder of the make bowl 28.2. There is also a bowl section 28.5 as well as a rim 29.2 and a shaft section 28.6. Sheath 28.9 fits inside of sheath 28.8. FIG. 26 shows a cross-sectional view of this bowl which shows inner sheath 28.9, rounded bowl section 28.5 screen 228.2 and shaft 28.6 extending out downstream from screen 228.2.

Figure 27:
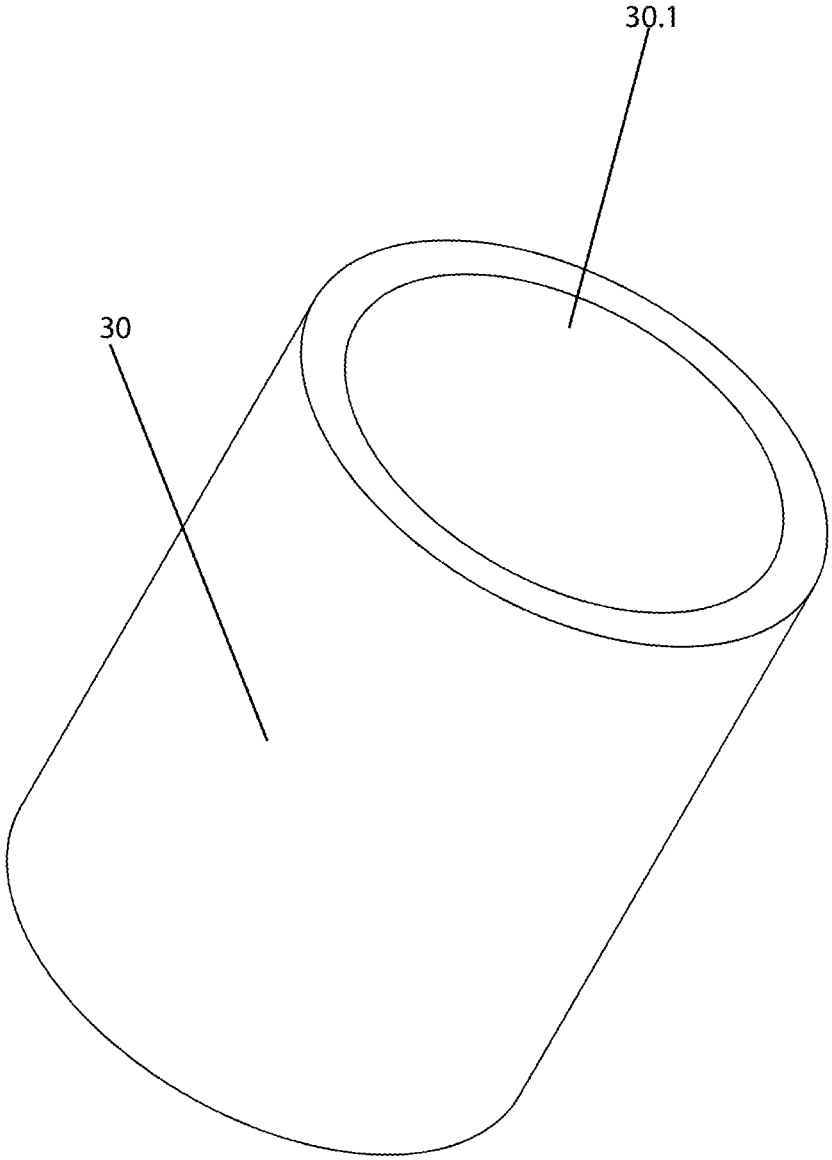
FIG. 27 is a perspective view of the centerpiece.
Figure 28:
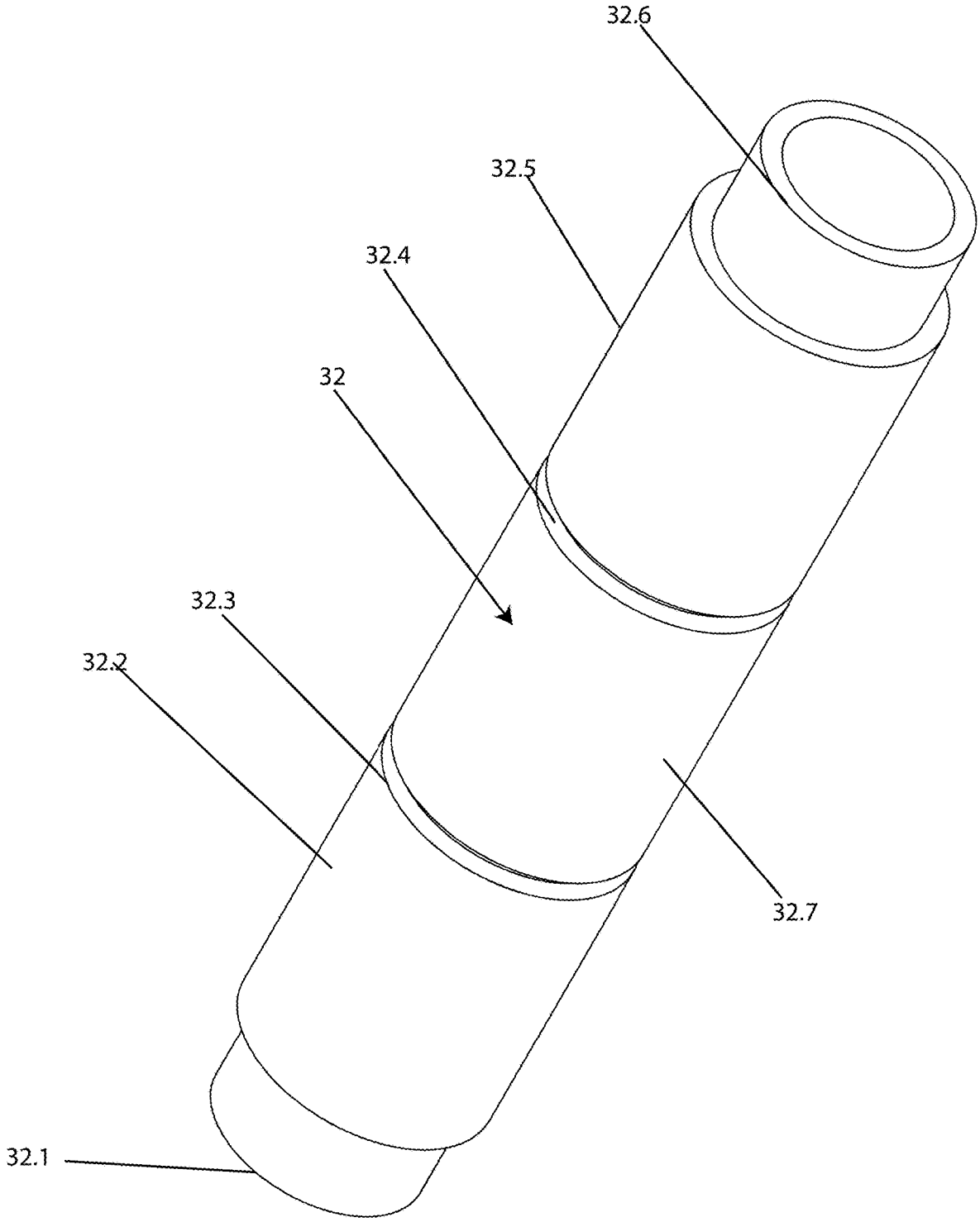
FIG. 28 is a perspective view of the stem.
Figure 29:
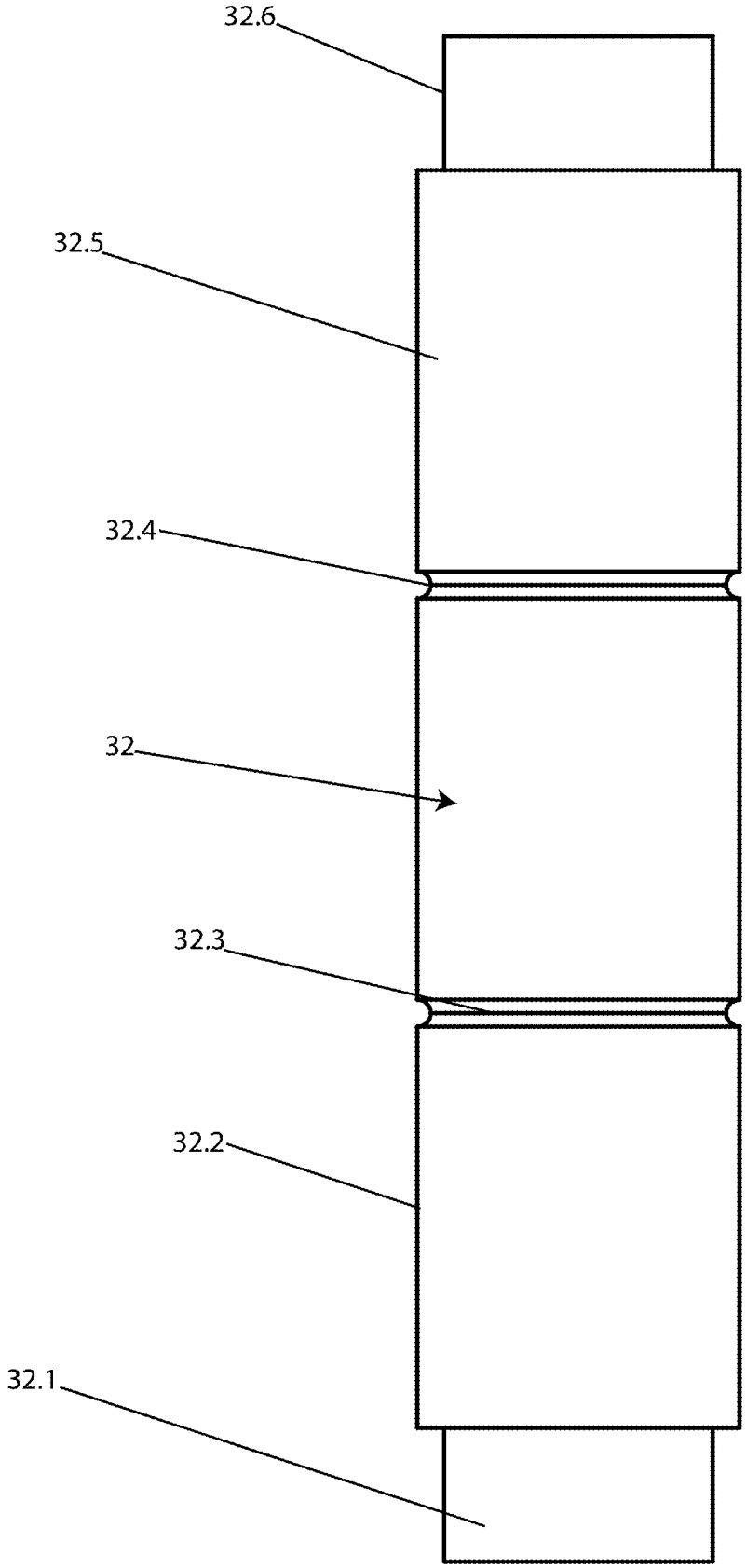
FIG. 29 is a front/rear or top/bottom view of the stem.
Figure 30:
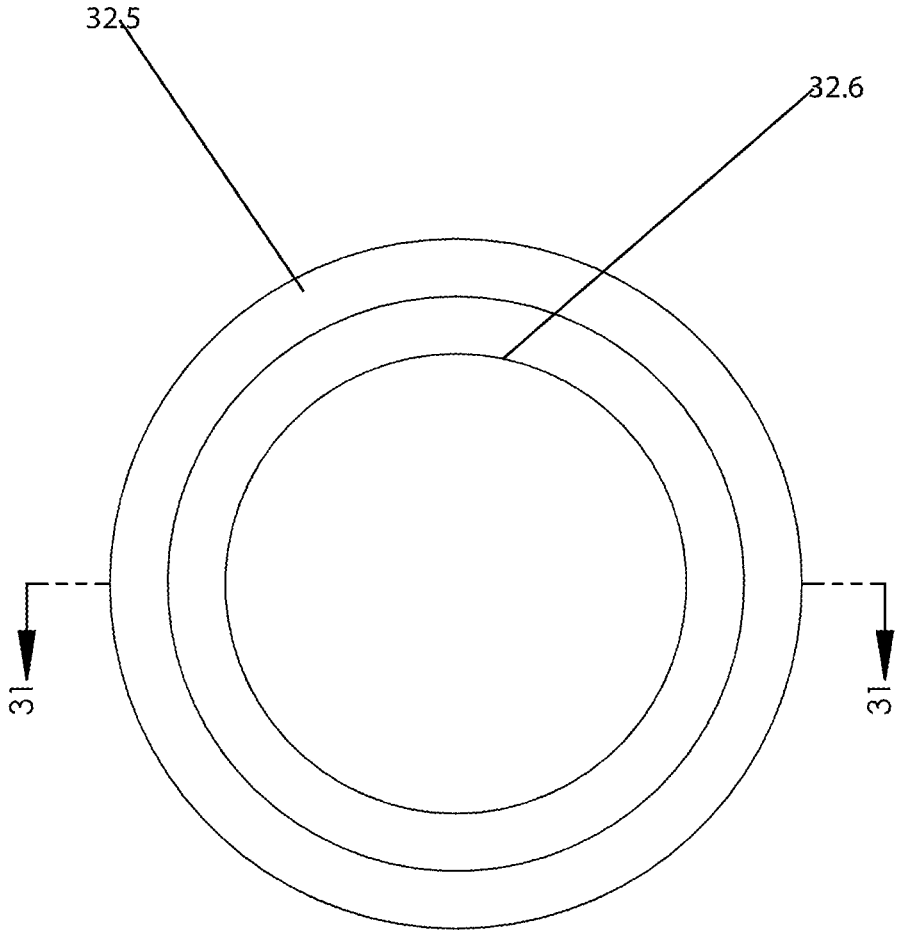
FIG. 30 is an end view of the stem.
Figure 31:
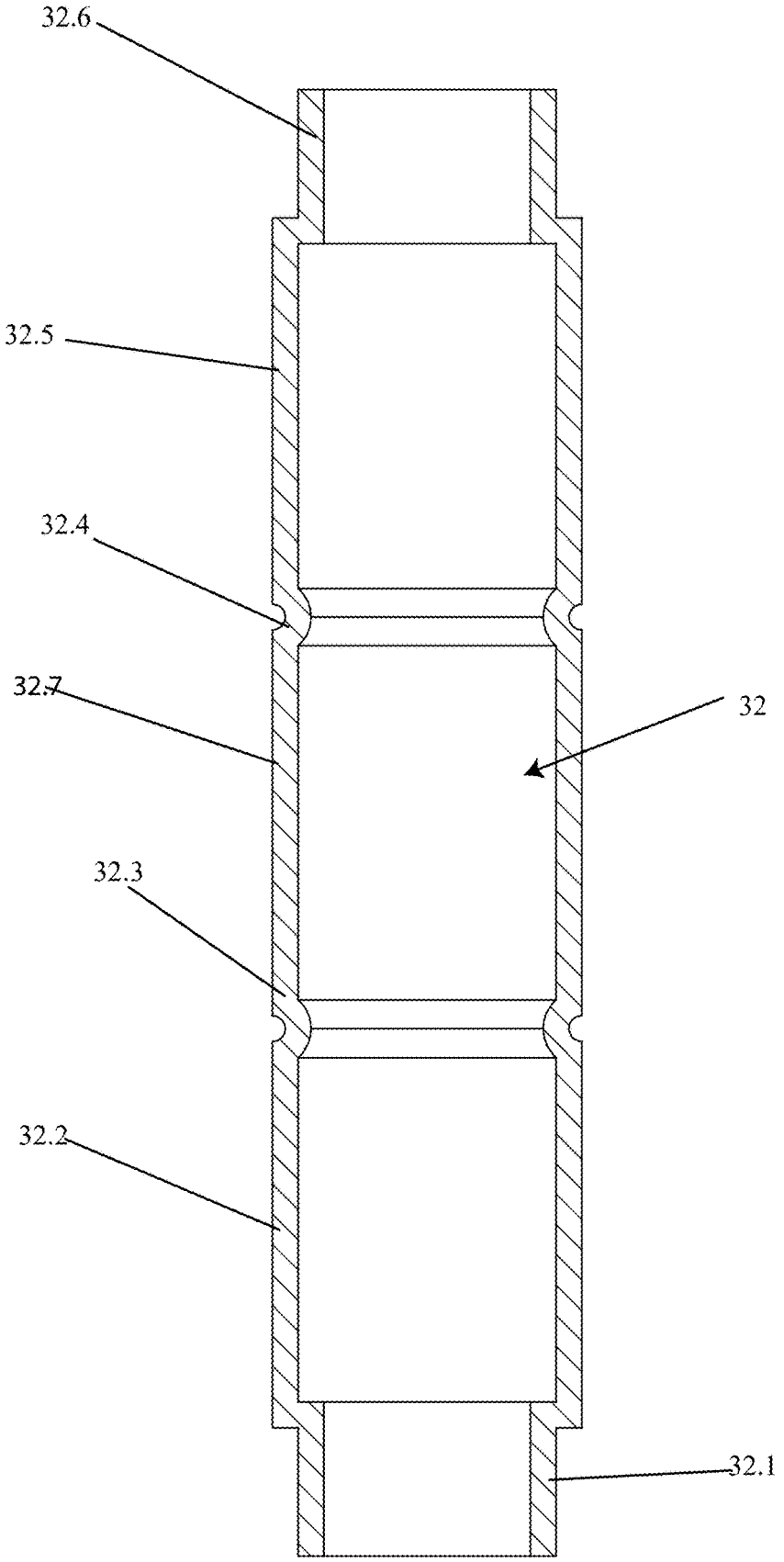
FIG. 31 is a cross-sectional view of the stem taken along line 31-31 in FIG. 30.

As seen in FIG. 27, the smoking pipe contains a centerpiece 30. The centerpiece 30 can be of any shape, size, material, features, type or kind, orientation, location, quantity, components, and arrangements of components that would allow the present invention to fulfill the objectives and intents of the present invention. However, it can be preferred that the centerpiece 30 be of a material similar to and/or compatible with the material of the smoking pipe. It can be preferred that the centerpiece 30 be of a shape and size similar to the shape and size of the second tail of the male bowl. It can be preferred that an end of the centerpiece 30 be connected to the second tail, while the opposite end of the centerpiece 30 be connected to an end of the stem 32.

As seen in FIG. 28 through FIG. 31, the smoking pipe contains a stem 32. The stem 32 can be of any shape, size, material, features, type or kind, orientation, location, quantity, components, and arrangements of components that would allow the present invention to fulfill the objectives and intents of the present invention. However, it can be preferred that the stem 32 be of a material similar to and/or compatible with the material of the smoking pipe. It can be preferred that the stem 32 be of a shape and diameter similar to the shape and diameter of the centerpiece 30. It can be preferred that the stem 32 be of a length that is significantly longer than the length of the centerpiece 30. It can be preferred that an end 32.1 of the stem 32 be connected to an end of the centerpiece 30 that is not connected to the second tail of the male bowl. It can be preferred that the other end 32.6 of the stem 32 be connected to an end of the second mouthpiece. Essentially the stem 32 comprises a first end 32.1 a plurality of sections 32.2, 32.7, and 32.5 as well as indented rims or knurling 32.3 and 32.4 for gripping the stem 32.

In alternative embodiment of the present invention, the present invention could be operated without the use of a face mask 40 and/or air pump 20. In such an alternative embodiment, the smoking pipe can include an additional bowl 124 coupled to a third channel or ignition port 27. In another alternative embodiment of the present invention, the smoking pipe can contain a second three-way connector or ignition housing 126 attached to the bowl 28 or the free end of the stem 32 not attached to the centerpiece 30 by the third channel of this second three-way connector or ignition housing 126 such that the present invention can facilitate use of the present invention by at least two users with two separate mouthpieces 24 and 34. In this alternative embodiment of the present invention, the smoking pipe can contain a third mouthpiece 134 attached to an end of the second three-way connector or ignition housing 126 not containing the second mouthpiece. Also, the present invention would contain a second face mask 140 attached to the third mouthpiece 134. Alternatively, another mask 240 is coupled to the channel or tube 236 which is coupled to the channel or tube 36 which feeds the first face mask 40 is attached to the second mouthpiece. In yet another alternative embodiment of the present invention, the present invention can contain a plurality of graphical features.

The plurality of graphical features can be of any shape, size, material, features, type or kind, orientation, location, quantity, components, and arrangements of components that would allow the present invention to fulfill the objectives and intents of the present invention. However, it can be preferred that the plurality of graphical features be of a type or kind such that the plurality of graphical features can include, but is not limited to, the following: colors, color schemes, patterns, motifs, illustrations, pictures, logos, trademarks, mascots, graphics, images, other similarly related objects, and/or any combination thereof. It could be preferred that the plurality of graphical features be located on all primary components of the present invention (air pump 20, face mask 40, and smoking pipe) or on individual selected primary components of the present invention; such as, only on the smoking pipe but not on the air pump 20 or face mask 40. The present inventor has created a device which allows mechanical air to flow through a smoking pipe and then to a face breathing mask. The chambers of the smoking pipe are filled with tobacco products then the pipe tobacco is lit and then the air pump 20 is turned on allowing for maximum tobacco smoke to be accumulated at the face mask 40. The air pump 20 is an electric air pump 20, hand pump or a battery-operated air pump 20. The tobacco product can be cigarette tobacco, hookah tobacco, hemp, marijuana or any type of product that is smoked. The air pump 20 can be dismantled, and the pipe used without the air pump 20 as regular smoking pipe. The smoking pipe has an air intake at the mid center of the pipe to allow for a better air flow. The pipe is available in 5 different colors and comes in a pouch with extra screens for the pipe. The center chamber that holds the tobacco can be of any material and can hold a lit tobacco cigarette and the forced air now keeps that lit. Extends the center chamber allowing it to hold and burn tobacco products as we have now. It now holds about 2.5 grams now and the new version would hold about 7 grams, or it can hold a 4-inch cigarette, or anything rolled.

FIG. 32A is a side top perspective view of another embodiment 111 of the invention. In this side view there is shown a first mouthpiece 24 having a tip 23 coupled to an ignition housing 26 at a first end via shaft 25. As described above, the ignition housing 26 includes an ignition port 27 for receiving a flame. There is a bowl 124 which has a stem 123 which fits inside of ignition port 27. This bowl 124 is configured to receive smokeable material such that it can be lit, and the smoke can enter through the ignition port 27 and the smoke would then flow down through the ignition port 27 through the bowl 28 or through the long stem 32 through the mouthpiece 34 and out the tip 35. The user could inhale through mouthpiece 34 having tip 35 and then control whether he/she receives smoke by selectively sealing tip 23 against air flow, such as through the use of their finger.

FIG. 32B shows another embodiment which shows a double ended pipe which has two separate ignition housings 26 and 226 with two separate ignition ports 27 and 227 respectively. Positioned between these two ignition housings 26 and 226 is a bowl 28 which includes female bowl 28.1 and male bowl 28.2. At each end of this pipe are mouthpieces 24 and 34 with respective tips 23 and 35. The user inhaling using mouthpiece 24, would light the end with ignition port 227 and inhale through tip 23 drawing the flame into bowl 28. Alternatively, the person inhaling using mouthpiece 34 would light through ignition port 27 causing a flame to go through bowl 28 lighting the smokable material inside of bowl 28 causing air and smoke to go through tip 35.

Figure 33A:
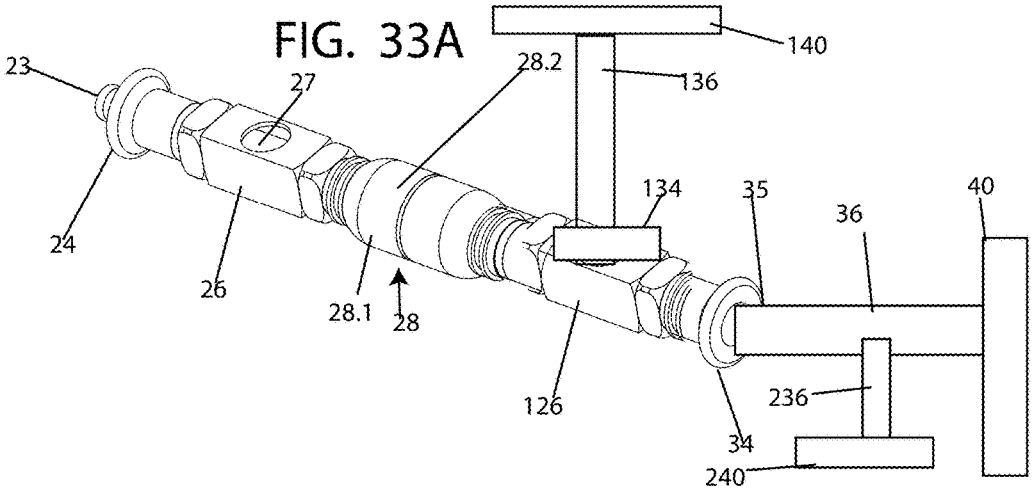
FIG. 33A is a perspective view of another embodiment of the invention.

FIG. 33A is a perspective view of another embodiment of the invention which is similar to that of FIG. 32B. In this view there are two mouthpieces 24 and 34, wherein disposed between these mouthpieces are ignition housings 26 and 126 having ignition ports 27 and 127. Coupled to ignition port 127 is a mask 140 which is coupled to tube 136 and which has a coupling in the form of a third mouthpiece 134 which couples to ignition port 127. When a user seeks to inhale smokable material inside of bowl 28, the user lights a lighter into port 27 draws a flame through to bowl 28 (female bowl 28.1 and male bowl 28.2. The smoke can then be shared with one of three masks 140, 40, or 240. Mask 40 is coupled via tube 36 to tip 35 of mouthpiece 34. Mask 240 has a tube 236 which branches off of tube 36 thereby drawing smoke into mask 240.

Figure 33B:
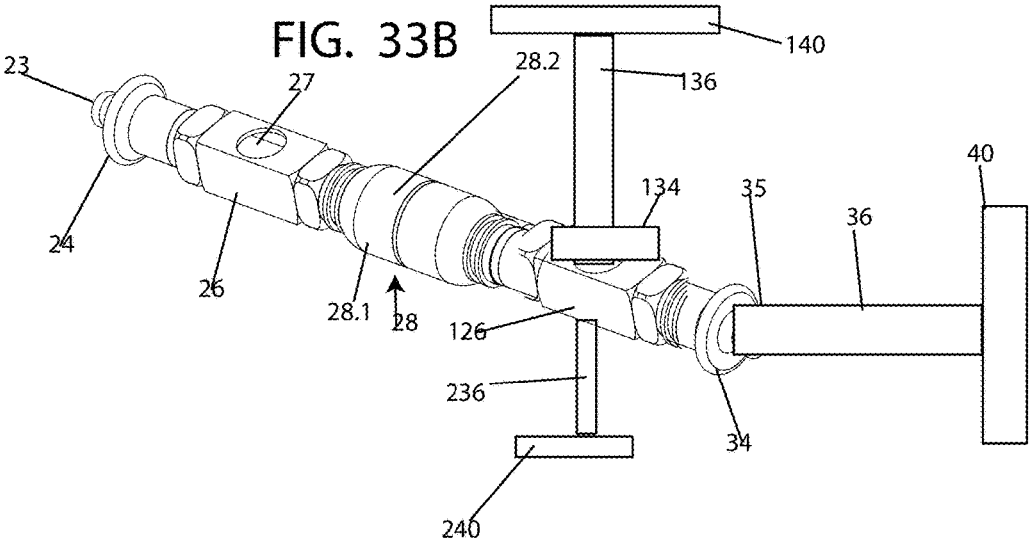
FIG. 33B is a side perspective view of another embodiment of the invention.

FIG. 33B shows another perspective view of another embodiment including a mouthpiece 24 having a tip 23. Coupled to the mouthpiece 24 is an ignition housing 26 having an ignition hole 27. There is a bowl 28 having a female bowl 28.1 and a male bowl 28.2 (see above. The male bowl is coupled to a four-way connector 126 having four ports (See FIG. 18B). At least two of the ports 127 and 227 (See FIG. 18B) are positioned opposite each other and are configured to be coupled to respective tubes. For example, there is connector 134, coupled to port 127, which then couples to tube 136 and then on to mask 140. The coupling 134 can be a screw in threaded coupling which screws into a female threaded opening 127. In addition, another port 227 (not shown here but see FIG. 18B) is coupled to tube 236 in a similar manner through a screw in coupling (not shown here). This tube 236 leads to mask 240. Thus, with this design there are three separate masks 40, 140 and 240 which can be used by a user and secured to a user's face.

Figure 34A:
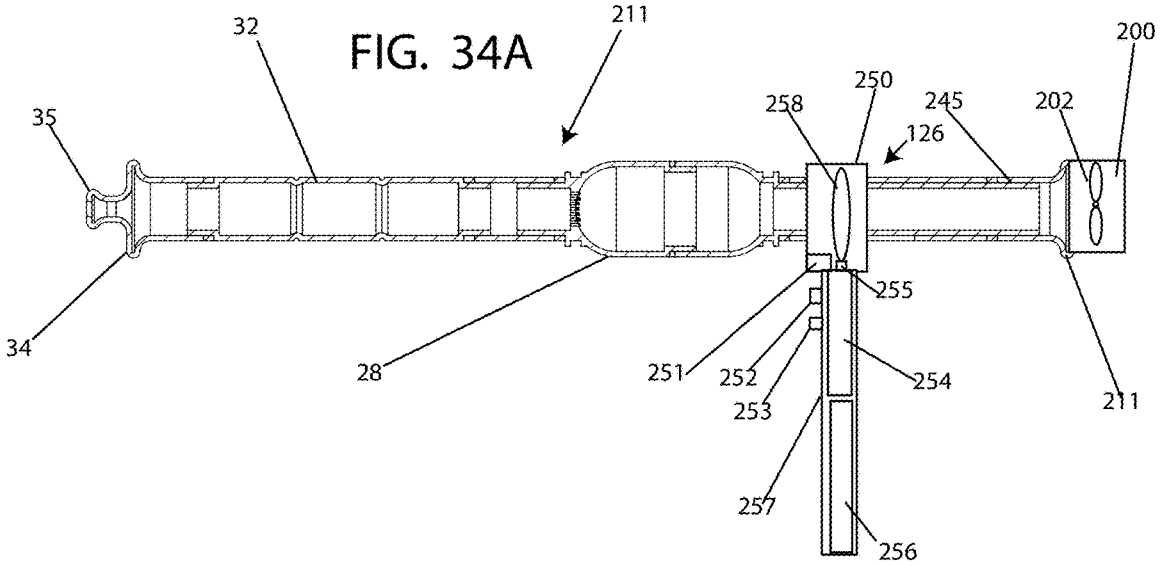
FIG. 34A is a side view of another embodiment of the invention.

FIG. 34A is a cross-sectional view of another embodiment, which shows another pipe which shows mouthpiece 34 having tip 35 which is coupled to stem 32. Bowl 28 is shown coupled to shaft 245. Coupled to shaft 245 is a coupling 250 which is configured to fit over a four-port ignition housing 126.

Housing 250 is coupled to housing/handle or shaft 257. Coupled to this shaft 257 and disposed inside of this shaft 257 is a battery 256, and a lighter fluid container 254. In addition, coupled to the shaft 257 are buttons 252 and 253. Button 252 is for activating the sparker/spark plug 251 to send a spark inside of housing 250. In addition, when this button 252 is pressed it opens a valve, that is biased closed for fluid container 254 thereby opening fluid container 254 through port 255. Another button 253 is configured to activate fan 200 turning fan blade 202 such that pressing button 253 sends power from battery 256 to the fan 200 to operate the fan.

Inside of coupling 250 is an ignition system 251 which is powered by battery 252. The ignition system includes a battery powered sparkler or spark plug which generates a spark sufficient to ignite the smokeable material inside of a bowl.

Battery 256 is configured to drive a fan 200 coupled to an end of the pipe body 211. In at least one embodiment, this fan 200 has a fan body coupled integral or connected directly to with the pipe body 211. Fan 200 includes a fan blade 202 which when it rotates draws air into the fan body and passes it from the fan through shaft 245 into bowl 28 down stem 32 and then out mouthpiece 34 and through tip 35.

Figure 34B:
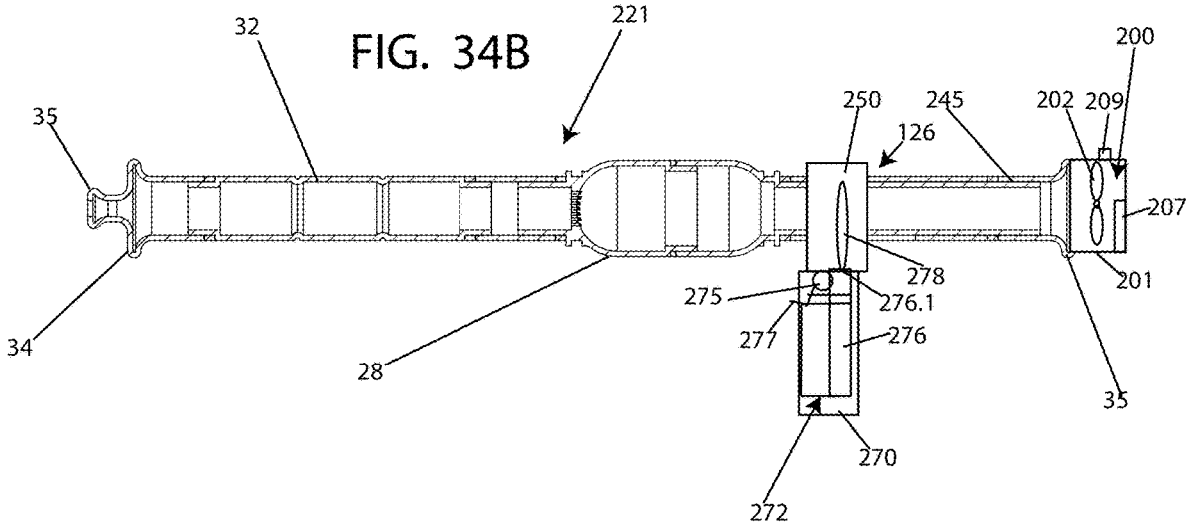
FIG. 34B is a side view of another embodiment of the invention.

FIG. 34B is a view of an embodiment similar to that of FIG. 34A however with this embodiment, there is still housing 250 coupled over ignition housing 126 which forms a four-way port (see FIG. 18B). There is a shaft 270 coupled to this ignition housing 126 and housing 250. Inside of housing 250 is flame 278. A lighter 272 is disposed inside of handle 270, wherein lighter 272 has a striker 275, a butane or fuel housing 276 and a lever 277. With this design, a user can strike the striker 275 to create flame 278. The striking of the striker 275 can be through the user rolling his or her thumb down across the striker in a manner similar to a lighter so that this causes a rotation of the striker with a steel wheel hitting a flint and thereby causing a spark. When the user's thumb or other finger gets to the bottom of the rotation, the thumb then hits lever 277 causing a valve 276.1 in the butane housing 276 to open thereby allowing gas to flow out and a flame 278 to be created from the spark.

The user can also push button 209 which is coupled to battery 207. Button 209 is coupled to fan 200 as well. Battery 207 is disposed inside of fan housing 201. When button 209 is pressed this activates the fan 200 turning fan blade 202 and drawing air inside of chamber 245, where it flows into flame 278 thereby igniting the smokeable material inside of bowl 28. The smokeable material when it is lit then has the smoke blown by fan 200 and fan blade 202 to cause smoke to flow through stem 32 and out of mouthpiece 34 and through tip 35. The user of this device can then put their mouth on mouthpiece 34 and inhale the smoke from tip 35.

FIG. 35A shows a top view of the ignition housing 26 having ignition port 27 wherein there is a rotatable fastener 327.7 coupled to a cover 327. This ignition housing 26 has a shaft 26.1 and a first end 26.2 and a second end 26.4. The cover 327 is configured to cover over ignition port 27 when this cover is rotated to be positioned just above ignition port 27. This allows for the sealing of the ignition port to trap air inside. With this cover 327, this keeps a user from having to use his or her finger to seal the port 27 against air flow.

FIG. 35B shows a top view of the cover 327 having a rotatable fastener 327.1 as shown in FIG. 35A but it also includes a finger grip 327.2 which allows a user to place their finger on the cover 327 and rotate the cover 327 around the rotatable fastener 327.1 to selectively close the ignition hole 27.

Figure 36:
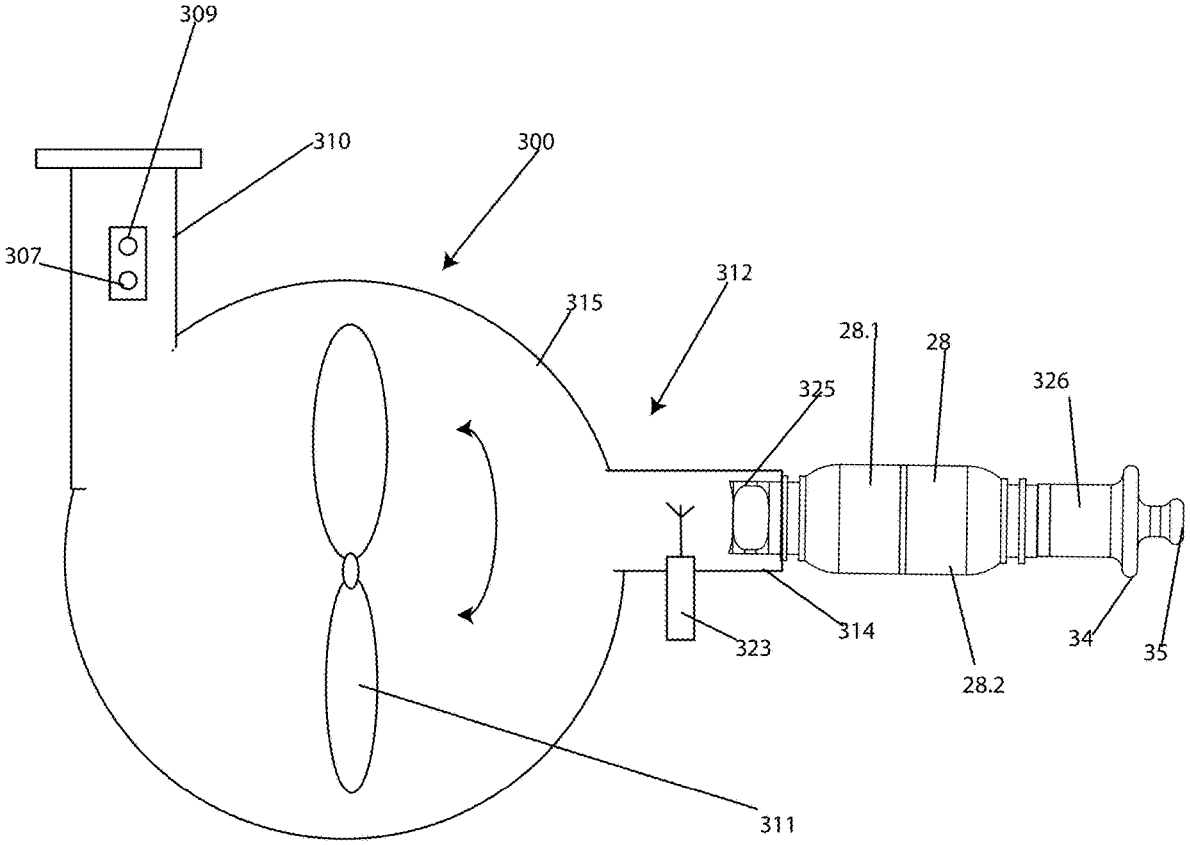
FIG. 36 is a side cut away view of another embodiment of the invention.

FIG. 36 is a side cut away view of another embodiment of the invention 300 which includes a large fan 312 having a large fan blade 311. There is an on/off switch 309, positioned along an input shaft 310 for air intake into the fan housing 315. The housing 315 leads into a shaft section 314, which leads into a shaft 325 forming an air outflow from fan body or housing 315 but positioned upstream from bowl 28. As described above bowl 28 is configured to house smokable material which allows air to flow into shaft 326 onto mouthpiece 24 and out of tip 35. Because of the large and powerful nature of the fan 312 it creates a smoke creation machine dispersing smoke from the ignited smokable material inside of bowl 28. There is a battery powered sparker or lighter 323 formed along the air outflow of the fan body which is configured to send a flame or spark into bowl 28 which ignites the smokeable material when a user pushes the on switch 309 on the on/off switch 309. The off button 307 is positioned adjacent to the on switch 309. Thus, when a user switches on the on/off switch 309 it draws air into input shaft 310 with fan 312 being turned on rotating blade 311. The sparker 323 sends a spark or flame into bowl 28 which houses the smokeable material. This material is ignited and then causes smoke to flow through shaft 326 through mouthpiece 34 and out of tip 35 thereby flooding a room with smoke.

Figure 37:
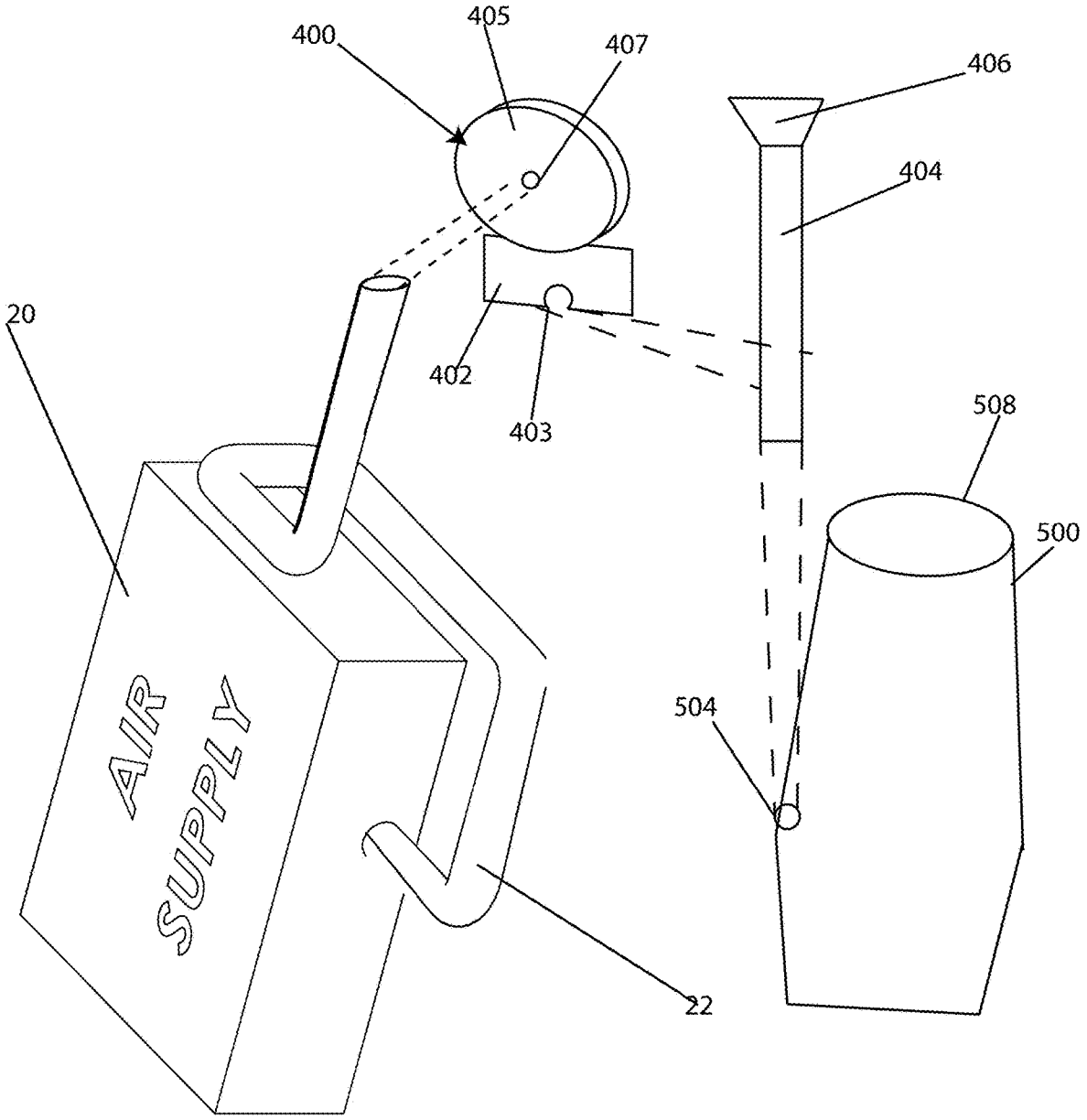
FIG. 37 is a perspective view of another embodiment of the invention.

FIG. 37 is a perspective view of another embodiment of the invention which shows a fan such as fan or pump 20 which is coupled to shaft 22. The fan is configured to send air through shaft 22 and into cap or seal 400. Cap or seal 400 has a fastener 402 for coupling to a stem 404 of a bowl 406 of a water pipe. Fastener 402 has a notch 403 which connects around shaft or stem 404 of the stem 404 of a bowl 406. A central coupling 407 is disposed in cap body 405. Central coupling 407 is configured to receive shaft 22 to receive the feed of air from shaft 22 and then feed this air into a closed connection with bowl 406. Thus, when cap 400 is placed over bowl 406, it seals or substantially seals a top of bowl 406 thereby forcing pressurized air into bowl 406 and then into step 404. Once a smokeable material is filled in bowl 406 and light with an object such as a lighter the user can start the fan 20 and place the cap 400 over the bowl. The steady state of pressure of air flowing into the sealed bowl (sealed by the cap) causes the continued ignition of the smokeable material and thereby results in a steady state stream of smoke flowing through the stem 404 and into for example a water pipe such as water pipe 500 which is configured to be coupled to stem 404 and bowl 406. In this view it is shown that stem 404 fits into hole 504 in water pipe 500. A top of the water pipe 508 allows air to escape the water pipe and to flow out of the water pipe and then towards a user.

Figure 38:
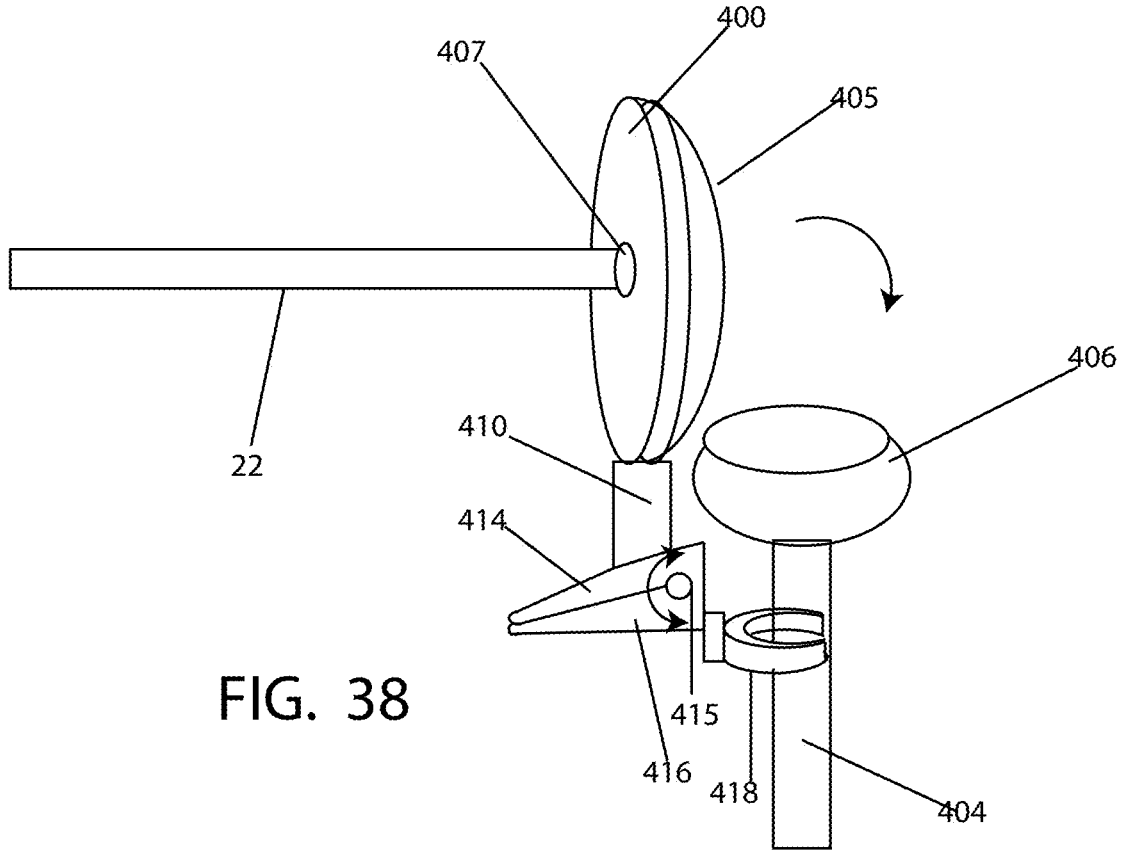
FIG. 38 is a side view of the embodiment shown in FIG. 37.

FIG. 38 is a side view of an alternative embodiment of the embodiment shown in FIG. 37. In this view, there is coupling 407 which connects to shaft 22. Coupling 407 is part of cap body 405 of cap 400. Coupled to cap 400 is a block 410 and another rotatable block 413 having a first part 414, a second part 416 and a middle spring loaded axle 415 which allows first part 414 to rotate around spring loaded axle thereby separating first part 414 from second part 416 and allowing cap 400 to rotate in the path of the arrow in a clockwise manner down towards a bowl 406 which is coupled to stem 404. In this way the cap 400 including the semi-spherical cap body 405 covers bowl 406 in a flush manner thereby pumping air through shaft or channel 22 into the bowl 406 so as to keep bowl 406 lit and smoking once it has been already lit because it is being sustained by the constant air flow into bowl 406.

Figure 39:
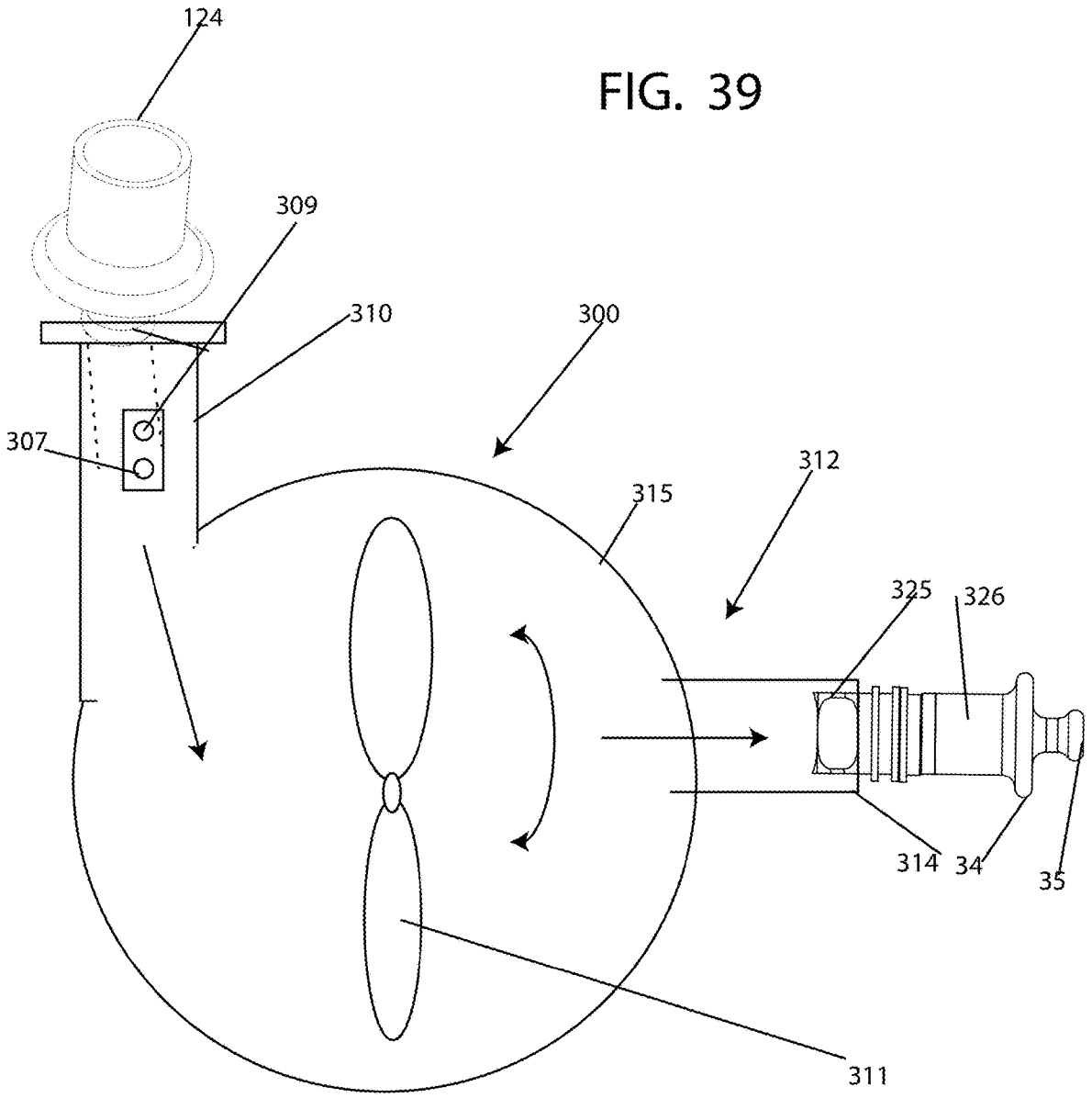
FIG. 39 is a view of another embodiment of the invention.

FIG. 39 is another embodiment of the invention. For example, there is shown a side cut away view of another embodiment of the invention 301 which includes a portable bowl 124 coupled to a large fan 312 having a large fan blade 311. There is an on/off switch 309, positioned along an input shaft 310 for air intake into the fan housing 315. The housing 315 leads into a shaft section 314, which leads into a shaft 325 forming an air outflow. Air then flows into shaft 326 onto mouthpiece 34 and out of tip 35. Because of the large and powerful nature of the fan 312 it creates a smoke creation machine dispersing smoke from the ignited smokable material inside of bowl 124. The off button 307 is positioned adjacent to the on switch 309. Thus, when a user switches on the on/off switch 309 it draws air into input shaft 310 with fan 312 being turned on rotating blade 311. This material is ignited and then causes smoke to flow through shaft 326 through mouthpiece 34 and out of tip 35 thereby flooding a room with smoke. The bowl 124 has smokeable material inside of it which can be ignited by any suitable device such as a lighter. The fan 312 creates a negative pressure inside of the housing showing the air flow via the directional arrows.

Throughout all of the different embodiments, the functioning aspect is the same. After the user lights it and the pump are on the air keeps the cigarette lit allowing smoke to come out the other end The user can then hook up the mask as we have now or just let it blow out the pipe. Although the invention has been explained in relation to its preferred embodiment, it is to be understood that many other possible modifications and variations can be made without departing from the spirit and scope of the invention.

Accordingly, while at least one embodiment of the present invention have been shown and described, it is to be understood that many changes and modifications may be made thereunto without departing from the spirit and scope of the invention as defined in the appended claims.

What is claimed is:

1. A modular smoking pipe comprising:

a body section having at least one ignition housing having at least one opening, and at least one bowl, wherein said body section is made from separate pieces screwed together such that said ignition housing is upstream from and separate from said at least one bowl and wherein said ignition housing has a hole, wherein said hole is disposed upstream from said at least one bowl and positioned separate and spaced apart from said at least one bowl;

at least one mouthpiece;

at least one input coupled to said body section;

at least one fan housing coupled to, but exterior to the body section, wherein said at least one fan housing is positioned upstream from said at last one ignition housing;

at least one fan disposed inside of the fan housing;

at least one tubing coupling said at least one fan housing to said body section;

wherein said at least one bowl is disposed adjacent to, and in line with said ignition housing, wherein said bowl is for receiving smoking material, said at least one bowl is formed with said body section, wherein said at least one fan is coupled to said at least one input upstream from said at least one body section and wherein said at least one opening in said body section is configured to receive a flame, wherein said at least one fan is configured to push air through said at least one opening to drive a flame into said bowl to ignite the smoking material and to drive smoke through the body section to said mouthpiece, wherein said ignited smoking material is spaced downstream from said hole.

2. The modular smoking pipe as in claim 1, further comprising at least one handle, said at least one handle coupled to said body section, said at least one handle configured to allow a user to hold the modular smoking pipe away without directly touching the body section.

3. The modular smoking pipe as in claim 1, further comprising at least one cover coupled to the body section, said at least one cover for selectively covering said opening in said body section.

4. The modular smoking pipe as in claim 1, wherein the body section is substantially cylindrical.

5. The modular smoking pipe as in claim 1, wherein said bowl comprises at least two parts, wherein said at least two parts of said bowl are separable from each other.

6. The modular smoking pipe as in claim 5, wherein said bowl further comprises a male portion and a female portion and at least one screen.

7. The modular smoking pipe as in claim 1, further comprising at least one mask and at least one tube wherein said at least one mask is coupled to said at least one tube and said at least one tube is coupled to said body of said pipe.

8. The modular smoking pipe as in claim 7, further comprising at least one additional mask.

9. The modular smoking pipe as in claim 8, wherein said at least one additional mask is coupled to the body section via at least one additional tube.

10. The modular smoking pipe as in claim 8, wherein said at least one additional mask is coupled to said tube of said at least one mask.

11. The modular smoking pipe as in claim 1, further comprising at least one ignition housing coupled to the body section of the pipe.

12. The modular smoking pipe as in claim 11, wherein said at least one opening is positioned in said at least one ignition housing.

13. The modular smoking pipe as in claim 1, further comprising at least one battery pack coupled to said body section, said at least one battery pack for powering said fan.

14. The modular smoking pipe as in claim 13, further comprising at least one cap, wherein said at least one cap is for selectively covering said at least one opening in said body section.

15. The modular smoking pipe as in claim 14, further comprising at least one rotatable fastener, wherein said at least one cap is coupled to said body section via said at least one rotatable fastener.

16. The modular smoking pipe as in claim 15, wherein said at least one cap further comprises at least one finger grip coupled to said cap.

17. The modular smoking pipe as in claim 1 further comprising at least one cover (327), said cover (327) coupled to said at least one ignition housing, said cover configured to cover over said ignition port in said ignition housing.

18. The modular smoking pipe as in claim 1, further comprising at least one rotatable fastener (327.1), said at least one rotatable fastener (327.1) being configured to couple said at least one cover (327) to said at least one ignition housing.

19. The modular smoking pipe as in claim 17, wherein said at least one cover (327) further comprises at least one finger grip (327.2).

* * * * *